US009838819B2

(12) United States Patent
Peters et al.

(10) Patent No.: US 9,838,819 B2
(45) Date of Patent: Dec. 5, 2017

(54) REDUCING CORRELATION BETWEEN HIGHER ORDER AMBISONIC (HOA) BACKGROUND CHANNELS

(71) Applicant: QUALCOMM Incorporated, San Diego, CA (US)

(72) Inventors: Nils Günther Peters, San Diego, CA (US); Dipanjan Sen, San Diego, CA (US); Martin James Morrell, San Diego, CA (US)

(73) Assignee: QUALCOMM Incorporated, San Diego, CA (US)

( * ) Notice: Subject to any disclaimer, the term of this patent is extended or adjusted under 35 U.S.C. 154(b) by 0 days.

(21) Appl. No.: 14/789,961

(22) Filed: Jul. 1, 2015

(65) Prior Publication Data

US 2016/0007132 A1 Jan. 7, 2016

Related U.S. Application Data

(60) Provisional application No. 62/020,348, filed on Jul. 2, 2014, provisional application No. 62/060,512, filed on Oct. 6, 2014.

(51) Int. Cl.
*H04R 5/00* (2006.01)
*G10L 19/00* (2013.01)
(Continued)

(52) U.S. Cl.
CPC ..... *H04S 5/00* (2013.01); *G10L 19/008* (2013.01); *H04R 5/04* (2013.01); *H04S 3/008* (2013.01); *H04S 2420/11* (2013.01)

(58) Field of Classification Search
CPC ..... G10L 19/008; G10L 19/08; G10L 19/032; G10L 19/038; G10L 19/0204;
(Continued)

(56) References Cited

U.S. PATENT DOCUMENTS

2011/0249821 A1 10/2011 Jaillet et al.
2012/0155653 A1* 6/2012 Jax ..... G10L 19/008 381/22
(Continued)

FOREIGN PATENT DOCUMENTS

EP 2665208 A1 11/2013
EP 2743922 A1 6/2014
WO 2014194099 A1 12/2014

OTHER PUBLICATIONS

International Preliminary Report on Patentability from International Application No. PCT/US2015/038943, dated Jun. 20, 2016, 18 pp.
(Continued)

*Primary Examiner* — Thang Tran
(74) *Attorney, Agent, or Firm* — Shumaker & Sieffert, P.A.

(57) ABSTRACT

In general, techniques are described for compression and decoding of audio data are generally disclosed. An example device for compressing audio data includes one or more processors configured to apply a decorrelation transform to ambient ambisonic coefficients to obtain a decorrelated representation of the ambient ambisonic coefficients, the ambient HOA coefficients having been extracted from a plurality of higher order ambisonic coefficients and representative of a background component of a soundfield described by the plurality of higher order ambisonic coefficients, wherein at least one of the plurality of higher order ambisonic coefficients is associated with a spherical basis function having an order greater than one.

40 Claims, 7 Drawing Sheets

(51) Int. Cl.

| | |
|---|---|
| ***H04S 5/00*** | (2006.01) |
| ***H04R 5/04*** | (2006.01) |
| ***H04S 3/00*** | (2006.01) |
| ***G10L 19/008*** | (2013.01) |

(58) Field of Classification Search
CPC ..... G10L 19/167; G10L 25/18; G10L 25/48; H04S 2420/03; H04S 2420/11; H04S 7/30; H04S 2400/01; H04S 2400/03; H04S 2400/15; H04S 3/00; H04S 3/008; H04S 3/02; H04S 5/00; H04S 5/005; H04R 3/00; H04R 5/00; H04R 5/033; H04R 5/04
See application file for complete search history.

(56) References Cited

U.S. PATENT DOCUMENTS

| | | | | |
|---|---|---|---|---|
| 2013/0216070 | A1* | 8/2013 | Keiler | G10L 19/008 381/300 |
| 2015/0098572 | A1* | 4/2015 | Krueger | G10L 19/008 381/22 |
| 2015/0154971 | A1* | 6/2015 | Boehm | G10L 19/008 704/500 |
| 2015/0213803 | A1 | 7/2015 | Peters et al. | |
| 2015/0332679 | A1* | 11/2015 | Kruger | G10L 19/008 381/23 |
| 2015/0373473 | A1* | 12/2015 | Boehm | H03G 5/005 381/303 |
| 2016/0104495 | A1* | 4/2016 | Peters | G10L 19/008 381/22 |
| 2016/0219388 | A1* | 7/2016 | Oh | H04S 3/00 |
| 2016/0309273 | A1* | 10/2016 | Keiler | H04S 3/02 |

OTHER PUBLICATIONS

International Search Report and Written Opinion from International Application No. PCT/US2015/038943, dated Sep. 24, 2015, 17 pp.
Pulkki, "Spatial Sound Reproduction with Directional Audio Coding," Journal of the Audio Engineering Society, Jun. 2007, vol. 55 (6), pp. 503-516.
"Call for Proposals for 3D Audio," ISO/IEC JTC1/SC29/WG11/N13411, Jan. 2013, Geneva, CH, 20 pp.
Herre et al., "MPEG-H 3D Audio—The New Standard for Coding of Immersive Spatial Audio," IEEE Journal of Selected Topics in Signal Processing, vol. 9, No. 5, Aug. 2015, pp. 770-779.
Poletti, "Three-Dimensional Surround Sound Systems Based on Spherical Harmonics," J. Audio Eng. Soc., vol. 53, No. 11, Nov. 2005, pp. 1004-1025.
"Information technology—High efficiency coding and media delivery in heterogeneous environments—Part 3: Part 3: 3D Audio, Amendment 3: MPEG-H 3D Audio Phase 2," ISO/IEC JTC 1/SC 29N, Jul. 25, 2015, 208 pp.
"Information technology—High efficiency coding and media delivery in heterogeneous environments—Part 3: 3D Audio," ISO/IEC JTC 1/SC 29N, Apr. 4, 2014, 337 pp.
"Information technology—High efficiency coding and media delivery in heterogeneous environments—Part 3: 3D audio," ISO/IEC JTC 1/SC 29, Jul. 25, 2014, 311 pp.
"Ambisonic UHJ Format," Wikipedia.org, retrieved on Jul. 2, 2014, from https://en.wikipedia.org/wiki/Ambisonic_UHJ_format, 6 pp.
Response to Written Opinion dated Sep. 24, 2015, from International Application No. PCT/US2015/038943, filed on Apr. 29, 2016, 5 pp.

* cited by examiner

REDUCING CORRELATION BETWEEN HIGHER ORDER AMBISONIC (HOA) BACKGROUND CHANNELS

This application claims the benefit of:

U.S. Provisional Patent Application No. 62/020,348, titled "REDUCING CORRELATION BETWEEN HOA BACKGROUND CHANNELS," filed 2 Jul. 2014; and U.S. Provisional Patent Application No. 62/060,512, titled "REDUCING CORRELATION BETWEEN HOA BACKGROUND CHANNELS," filed 6 Oct. 2014, the entire contents of each of which are incorporated herein by reference.

TECHNICAL FIELD

This disclosure relates to audio data and, more specifically, coding of higher-order ambisonic audio data.

BACKGROUND

A higher-order ambisonics (HOA) signal (often represented by a plurality of spherical harmonic coefficients (SHC) or other hierarchical elements) is a three-dimensional representation of a soundfield. The HOA or SHC representation may represent the soundfield in a manner that is independent of the local speaker geometry used to playback a multi-channel audio signal rendered from the SHC signal. The SHC signal may also facilitate backwards compatibility as the SHC signal may be rendered to well-known and highly adopted multi-channel formats, such as a 5.1 audio channel format or a 7.1 audio channel format. The SHC representation may therefore enable a better representation of a soundfield that also accommodates backward compatibility.

SUMMARY

In general, techniques are described for coding of higher-order ambisonics audio data. Higher-order ambisonics audio data may comprise at least one higher-order ambisonic (HOA) coefficient corresponding to a spherical harmonic basis function having an order greater than one. Techniques are described for reducing correlation between higher order ambisonics (HOA) background channels.

In one aspect, a method includes obtaining a decorrelated representation of ambient ambisonic coefficients having at least a left signal and a right signal, the ambient ambisonic coefficients having been extracted from a plurality of higher order ambisonic coefficients and representative of a background component of a soundfield described by the plurality of higher order ambisonic coefficients, wherein at least one of the plurality of higher order ambisonic coefficients is associated with a spherical basis function having an order greater than one; and generating a speaker feed based on the decorrelated representation of the ambient ambisonic coefficients.

In another aspect, a method includes applying a decorrelation transform to ambient ambisonic coefficients to obtain a decorrelated representation of the ambient ambisonic coefficients, the ambient HOA coefficients having been extracted from a plurality of higher order ambisonic coefficients and representative of a background component of a soundfield described by the plurality of higher order ambisonic coefficients, wherein at least one of the plurality of higher order ambisonic coefficients is associated with a spherical basis function having an order greater than one.

In another aspect, a device for compressing audio data includes one or more processors configured to obtain a decorrelated representation of ambient ambisonic coefficients having at least a left signal and a right signal, the ambient ambisonic coefficients having been extracted from a plurality of higher order ambisonic coefficients and representative of a background component of a soundfield described by the plurality of higher order ambisonic coefficients, wherein at least one of the plurality of higher order ambisonic coefficients is associated with a spherical basis function having an order greater than one; and generate a speaker feed based on the decorrelated representation of the ambient ambisonic coefficients.

In another aspect, a device for compressing audio data includes one or more processors configured to apply a decorrelation transform to ambient ambisonic coefficients to obtain a decorrelated representation of the ambient ambisonic coefficients, the ambient HOA coefficients having been extracted from a plurality of higher order ambisonic coefficients and representative of a background component of a soundfield described by the plurality of higher order ambisonic coefficients, wherein at least one of the plurality of higher order ambisonic coefficients is associated with a spherical basis function having an order greater than one.

In another aspect, a device for compressing audio data includes means for obtaining a decorrelated representation of ambient ambisonic coefficients having at least a left signal and a right signal, the ambient ambisonic coefficients having been extracted from a plurality of higher order ambisonic coefficients and representative of a background component of a soundfield described by the plurality of higher order ambisonic coefficients, wherein at least one of the plurality of higher order ambisonic coefficients is associated with a spherical basis function having an order greater than one; and means for generating a speaker feed based on the decorrelated representation of the ambient ambisonic coefficients.

In another aspect, a device for compressing audio data includes means for applying a decorrelation transform to ambient ambisonic coefficients to obtain a decorrelated representation of the ambient ambisonic coefficients, the ambient HOA coefficients having been extracted from a plurality of higher order ambisonic coefficients and representative of a background component of a soundfield described by the plurality of higher order ambisonic coefficients, wherein at least one of the plurality of higher order ambisonic coefficients is associated with a spherical basis function having an order greater than one; and means for storing the decorrelated representation of the ambient ambisonic coefficients.

In another aspect, a computer-readable storage medium is encoded with instructions that, when executed, cause one or more processors of an audio compression device to obtain a decorrelated representation of ambient ambisonic coefficients having at least a left signal and a right signal, the ambient ambisonic coefficients having been extracted from a plurality of higher order ambisonic coefficients and representative of a background component of a soundfield described by the plurality of higher order ambisonic coefficients, wherein at least one of the plurality of higher order ambisonic coefficients is associated with a spherical basis function having an order greater than one; and generate a speaker feed based on the decorrelated representation of the ambient ambisonic coefficients.

In another aspect, a computer-readable storage medium is encoded with instructions that, when executed, cause one or more processors of an audio compression device to apply a decorrelation transform to ambient ambisonic coefficients to obtain a decorrelated representation of the ambient ambisonic coefficients, the ambient HOA coefficients having been extracted from a plurality of higher order ambisonic coefficients and representative of a background component of a soundfield described by the plurality of higher order ambisonic coefficients, wherein at least one of the plurality of higher order ambisonic coefficients is associated with a spherical basis function having an order greater than one.

The details of one or more aspects of the techniques are set forth in the accompanying drawings and the description below. Other features, objects, and advantages of the techniques will be apparent from the description and drawings, and from the claims.

DETAILED DESCRIPTION

Figure 1:
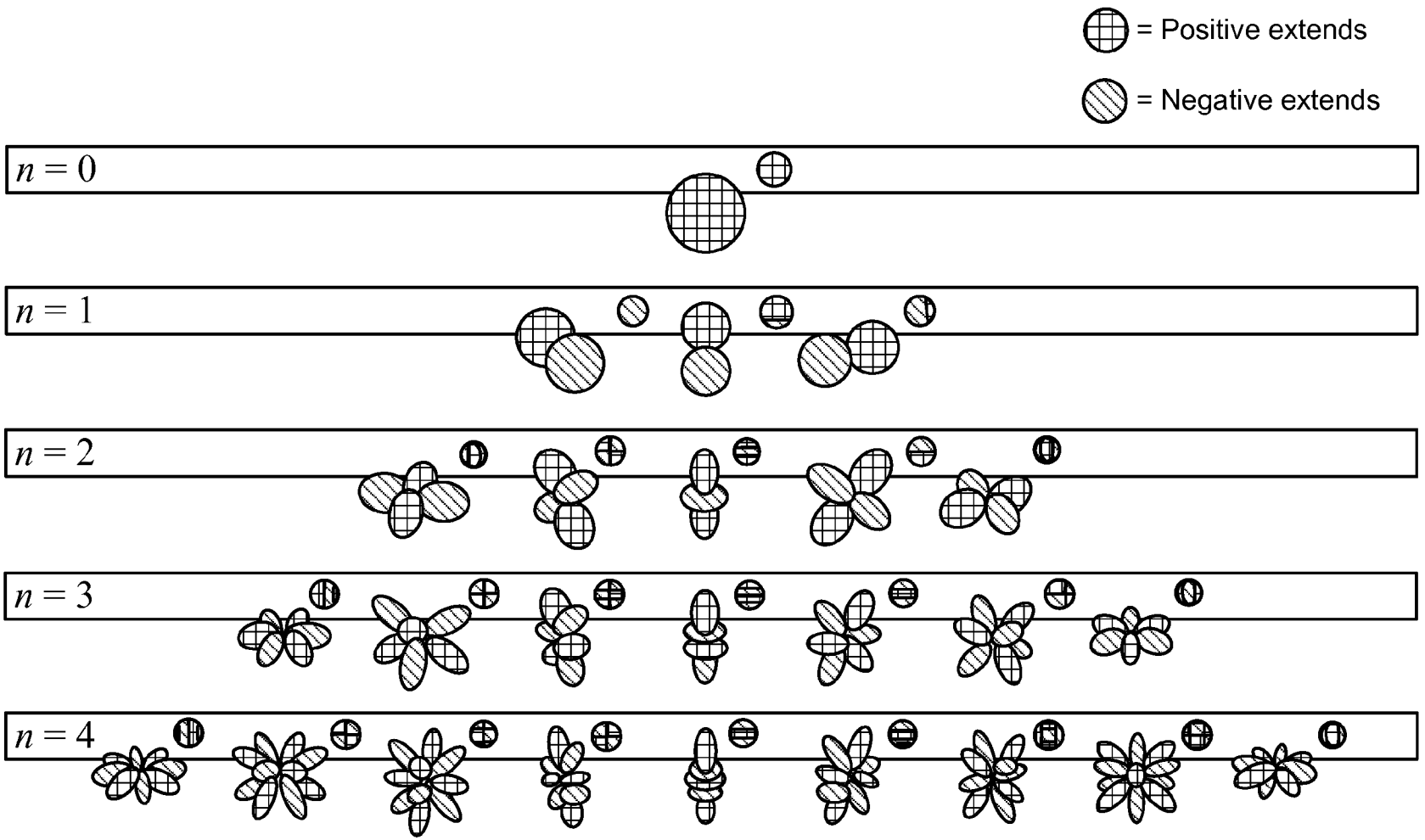
FIG. 1 is a diagram illustrating spherical harmonic basis functions of various orders and sub-orders.

The evolution of surround sound has made available many output formats for entertainment nowadays. Examples of such consumer surround sound formats are mostly 'channel' based in that they implicitly specify feeds to loudspeakers in certain geometrical coordinates. The consumer surround sound formats include the popular 5.1 format (which includes the following six channels: front left (FL), front right (FR), center or front center, back left or surround left, back right or surround right, and low frequency effects (LFE)), the growing 7.1 format, various formats that includes height speakers such as the 7.1.4 format and the 22.2 format (e.g., for use with the Ultra High Definition Television standard). Non-consumer formats can span any number of speakers (in symmetric and non-symmetric geometries) often termed 'surround arrays'. One example of such an array includes 32 loudspeakers positioned on coordinates on the corners of a truncated icosahedron.

The input to a future MPEG encoder is optionally one of three possible formats: (i) traditional channel-based audio (as discussed above), which is meant to be played through loudspeakers at pre-specified positions; (ii) object-based audio, which involves discrete pulse-code-modulation (PCM) data for single audio objects with associated metadata containing their location coordinates (amongst other information); and (iii) scene-based audio, which involves representing the soundfield using coefficients of spherical harmonic basis functions (also called "spherical harmonic coefficients" or SHC, "Higher-order Ambisonics" or HOA, and "HOA coefficients"). The future MPEG encoder may be described in more detail in a document entitled "Call for Proposals for 3D Audio," by the International Organization for Standardization/International Electrotechnical Commission (ISO)/(IEC) JTC1/SC29/WG11/N13411, released January 2013 in Geneva, Switzerland, and available at http://mpeg.chiariglione.org/sites/default/files/files/standards/parts/docs/w13411.zip.

There are various 'surround-sound' channel-based formats in the market. They range, for example, from the 5.1 home theatre system (which has been the most successful in terms of making inroads into living rooms beyond stereo) to the 22.2 system developed by NHK (Nippon Hoso Kyokai or Japan Broadcasting Corporation). Content creators (e.g., Hollywood studios) would like to produce the soundtrack for a movie once, and not spend effort to remix it for each speaker configuration. Recently, Standards Developing Organizations have been considering ways in which to provide an encoding into a standardized bitstream and a subsequent decoding that is adaptable and agnostic to the speaker geometry (and number) and acoustic conditions at the location of the playback (involving a renderer).

To provide such flexibility for content creators, a hierarchical set of elements may be used to represent a soundfield. The hierarchical set of elements may refer to a set of elements in which the elements are ordered such that a basic set of lower-ordered elements provides a full representation of the modeled soundfield. As the set is extended to include higher-order elements, the representation becomes more detailed, increasing resolution.

One example of a hierarchical set of elements is a set of spherical harmonic coefficients (SHC). The following expression demonstrates a description or representation of a soundfield using SHC:

$$p_i(t, r_r, \theta_r, \varphi_r) = \sum_{\omega=0}^{\infty}\left[4\pi\sum_{n=0}^{\infty} j_n(kr_r)\sum_{m=-n}^{n} A_n^m(k)Y_n^m(\theta_r, \varphi_r)\right]e^{j\omega t},$$

The expression shows that the pressure $p_i$ at any point $\{r_r, \theta_r, \phi_r\}$ of the soundfield, at time t, can be represented uniquely by the SHC, $A_n^m(k)$. Here, $k=\omega/c$, c is the speed of sound (~343 m/s), $\{r_r, \theta_r, \phi_r\}$ is a point of reference (or observation point), $j_n(\bullet)$ is the spherical Bessel function of order n, and $Y_n^m(\theta_r, \phi_r)$ are the spherical harmonic basis functions of order n and suborder m. It can be recognized that the term in square brackets is a frequency-domain representation of the signal (i.e., $S(\omega, r_r, \theta_r, \phi_r)$) which can be approximated by various time-frequency transformations, such as the discrete Fourier transform (DFT), the discrete cosine transform (DCT), or a wavelet transform. Other examples of hierarchical sets include sets of wavelet transform coefficients and other sets of coefficients of multiresolution basis functions. Higher Order Ambisonics signals are processed by truncating the higher orders so that only the zero and first order remain. We usually do some energy compensation of the remaining signals due to the loss the energy in the higher order coefficient.

Various aspects of this disclosure are directed to reducing correlation among background signals. For instance, techniques of this disclosure may reduce or possibly eliminate correlation between background signals expressed in the HOA domain. A potential advantage of reducing correlation between background HOA signals is the mitigation of noise unmasking. As used herein, the expression "noise unmasking" may refer to attributing audio objects to locations that do not correspond to the audio object in the spatial domain. In addition to mitigating potential issues related to noise unmasking, encoding techniques described herein may generate output signals that represent left and right audio signals, such as signals that together form a stereo output. In turn, a decoding device may decode the left and right audio signals to obtain a stereo output, or may mix the left and right signals to obtain a mono output. Additionally, in scenarios where an encoded bitstream represents a purely horizontal layout, a decoding device may implement various techniques of this disclosure to decode only horizontal components decorrelated HOA background signals. By limiting the decoding process to the horizontal components decorrelated HOA background signals, the decoder may implement the techniques to conserve computing resources and reduce bandwidth consumption.

FIG. 1 is a diagram illustrating spherical harmonic basis functions from the zero order (n=0) to the fourth order (n=4). As can be seen, for each order, there is an expansion of suborders m which are shown but not explicitly noted in the example of FIG. 1 for ease of illustration purposes.

The SHC $A_n^m(k)$ can either be physically acquired (e.g., recorded) by various microphone array configurations or, alternatively, they can be derived from channel-based or object-based descriptions of the soundfield. The SHC represent scene-based audio, where the SHC may be input to an audio encoder to obtain encoded SHC that may promote more efficient transmission or storage. For example, a fourth-order representation involving $(1+4)^2$ (25, and hence fourth order) coefficients may be used.

As noted above, the SHC may be derived from a microphone recording using a microphone array. Various examples of how SHC may be derived from microphone arrays are described in Poletti, M., "Three-Dimensional Surround Sound Systems Based on Spherical Harmonics," J. Audio Eng. Soc., Vol. 53, No. 11, 2005 November, pp. 1004-1025.

To illustrate how the SHCs may be derived from an object-based description, consider the following equation. The coefficients $A_n^m(k)$ for the soundfield corresponding to an individual audio object may be expressed as:

$$A_n^m(k)=g(\omega)(-4\pi ik)h_n^{(2)}(kr_s)Y_n^{m*}(\theta_s, \phi_s),$$

where i is $\sqrt{-1}$, $h_n^{(2)}(\bullet)$ is the spherical Hankel function (of the second kind) of order n, and $\{r_s, \theta_s, \phi_s\}$ is the location of the object. Knowing the object source energy $g(\omega)$ as a function of frequency (e.g., using time-frequency analysis techniques, such as performing a fast Fourier transform on the PCM stream) allows us to convert each PCM object and the corresponding location into the SHC $A_n^m(k)$. Further, it can be shown (since the above is a linear and orthogonal decomposition) that the $A_n^m(k)$ coefficients for each object are additive. In this manner, a multitude of PCM objects can be represented by the $A_n^m(k)$ coefficients (e.g., as a sum of the coefficient vectors for the individual objects). Essentially, the coefficients contain information about the soundfield (the pressure as a function of 3D coordinates), and the above represents the transformation from individual objects to a representation of the overall soundfield, in the vicinity of the observation point $\{r_r, \theta_r, \phi_r\}$. The remaining figures are described below in the context of object-based and SHC-based audio coding.

Figure 2:
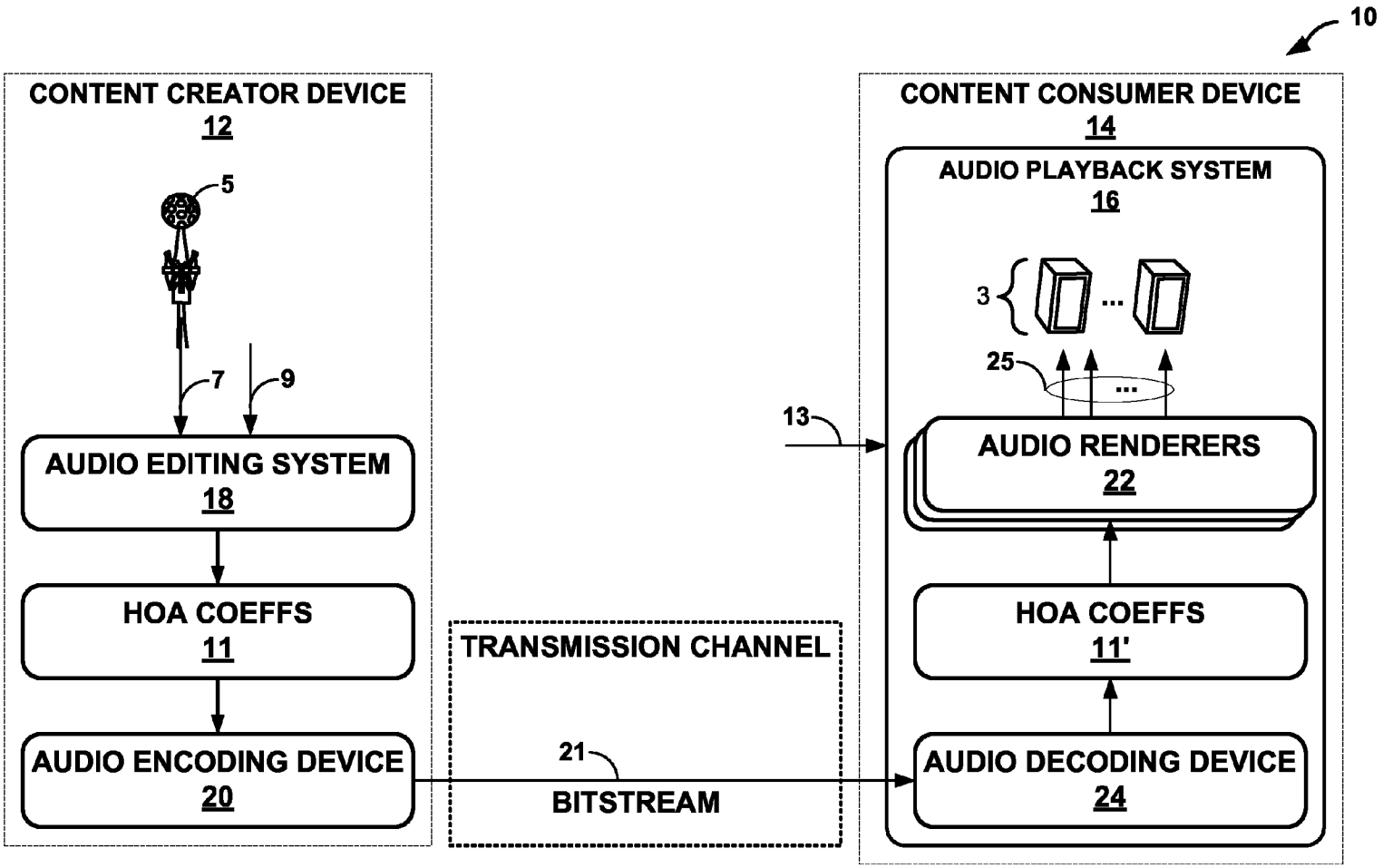
FIG. 2 is a diagram illustrating a system that may perform various aspects of the techniques described in this disclosure.

FIG. 2 is a diagram illustrating a system 10 that may perform various aspects of the techniques described in this disclosure. As shown in the example of FIG. 2, the system 10 includes a content creator device 12 and a content consumer device 14. While described in the context of the content creator device 12 and the content consumer device 14, the techniques may be implemented in any context in which SHCs (which may also be referred to as HOA coefficients) or any other hierarchical representation of a soundfield are encoded to form a bitstream representative of the audio data. Moreover, the content creator device 12 may represent any form of computing device capable of implementing the techniques described in this disclosure, including a handset (or cellular phone), a tablet computer, a smart phone, or a desktop computer to provide a few examples. Likewise, the content consumer device 14 may represent any form of computing device capable of implementing the techniques described in this disclosure, including a handset (or cellular phone), a tablet computer, a smart phone, a set-top box, or a desktop computer to provide a few examples.

The content creator device 12 may be operated by a movie studio or other entity that may generate multi-channel audio content for consumption by operators of content consumer devices, such as the content consumer device 14. In some examples, the content creator device 12 may be operated by an individual user who would like to compress HOA coefficients 11. Often, the content creator generates audio content in conjunction with video content. The content consumer device 14 may be operated by an individual. The content consumer device 14 may include an audio playback system 16, which may refer to any form of audio playback system capable of rendering SHC for play back as multi-channel audio content.

The content creator device 12 includes an audio editing system 18. The content creator device 12 obtain live recordings 7 in various formats (including directly as HOA coefficients) and audio objects 9, which the content creator device 12 may edit using audio editing system 18. A microphone 5 may capture the live recordings 7. The content creator may, during the editing process, render HOA coefficients 11 from audio objects 9, listening to the rendered speaker feeds in an attempt to identify various aspects of the soundfield that require further editing. The content creator device 12 may then edit HOA coefficients 11 (potentially indirectly through manipulation of different ones of the audio objects 9 from which the source HOA coefficients may be derived in the manner described above). The content creator device 12 may employ the audio editing system 18 to generate the HOA coefficients 11. The audio editing system 18 represents any system capable of editing audio data and outputting the audio data as one or more source spherical harmonic coefficients.

When the editing process is complete, the content creator device 12 may generate a bitstream 21 based on the HOA coefficients 11. That is, the content creator device 12 includes an audio encoding device 20 that represents a device configured to encode or otherwise compress HOA coefficients 11 in accordance with various aspects of the techniques described in this disclosure to generate the bitstream 21. The audio encoding device 20 may generate the bitstream 21 for transmission, as one example, across a transmission channel, which may be a wired or wireless channel, a data storage device, or the like. The bitstream 21 may represent an encoded version of the HOA coefficients 11 and may include a primary bitstream and another side bitstream, which may be referred to as side channel information.

While shown in FIG. 2 as being directly transmitted to the content consumer device 14, the content creator device 12 may output the bitstream 21 to an intermediate device positioned between the content creator device 12 and the content consumer device 14. The intermediate device may store the bitstream 21 for later delivery to the content consumer device 14, which may request the bitstream. The intermediate device may comprise a file server, a web server, a desktop computer, a laptop computer, a tablet computer, a mobile phone, a smart phone, or any other device capable of storing the bitstream 21 for later retrieval by an audio decoder. The intermediate device may reside in a content delivery network capable of streaming the bitstream 21 (and possibly in conjunction with transmitting a corresponding video data bitstream) to subscribers, such as the content consumer device 14, requesting the bitstream 21.

Alternatively, the content creator device 12 may store the bitstream 21 to a storage medium, such as a compact disc, a digital video disc, a high definition video disc or other storage media, most of which are capable of being read by a computer and therefore may be referred to as computer-readable storage media or non-transitory computer-readable storage media. In this context, the transmission channel may refer to the channels by which content stored to the mediums are transmitted (and may include retail stores and other store-based delivery mechanism). In any event, the techniques of this disclosure should not therefore be limited in this respect to the example of FIG. 2.

As further shown in the example of FIG. 2, the content consumer device 14 includes the audio playback system 16. The audio playback system 16 may represent any audio playback system capable of playing back multi-channel audio data. The audio playback system 16 may include a number of different renderers 22. The renderers 22 may each provide for a different form of rendering, where the different forms of rendering may include one or more of the various ways of performing vector-base amplitude panning (VBAP), and/or one or more of the various ways of performing soundfield synthesis. As used herein, "A and/or B" means "A or B", or both "A and B".

The audio playback system 16 may further include an audio decoding device 24. The audio decoding device 24 may represent a device configured to decode HOA coefficients 11' from the bitstream 21, where the HOA coefficients 11' may be similar to the HOA coefficients 11 but differ due to lossy operations (e.g., quantization) and/or transmission via the transmission channel. The audio playback system 16 may, after decoding the bitstream 21 to obtain the HOA coefficients 11' and render the HOA coefficients 11' to output loudspeaker feeds 25. The loudspeaker feeds 25 may drive one or more loudspeakers (which are not shown in the example of FIG. 2 for ease of illustration purposes).

To select the appropriate renderer or, in some instances, generate an appropriate renderer, the audio playback system 16 may obtain loudspeaker information 13 indicative of a number of loudspeakers and/or a spatial geometry of the loudspeakers. In some instances, the audio playback system 16 may obtain the loudspeaker information 13 using a reference microphone and driving the loudspeakers in such a manner as to dynamically determine the loudspeaker information 13. In other instances or in conjunction with the dynamic determination of the loudspeaker information 13, the audio playback system 16 may prompt a user to interface with the audio playback system 16 and input the loudspeaker information 13.

The audio playback system 16 may then select one of the audio renderers 22 based on the loudspeaker information 13. In some instances, the audio playback system 16 may, when none of the audio renderers 22 are within some threshold similarity measure (in terms of the loudspeaker geometry) to the loudspeaker geometry specified in the loudspeaker information 13, generate the one of audio renderers 22 based on the loudspeaker information 13. The audio playback system 16 may, in some instances, generate one of the audio renderers 22 based on the loudspeaker information 13 without first attempting to select an existing one of the audio renderers 22. One or more speakers 3 may then playback the rendered loudspeaker feeds 25.

Figure 3:
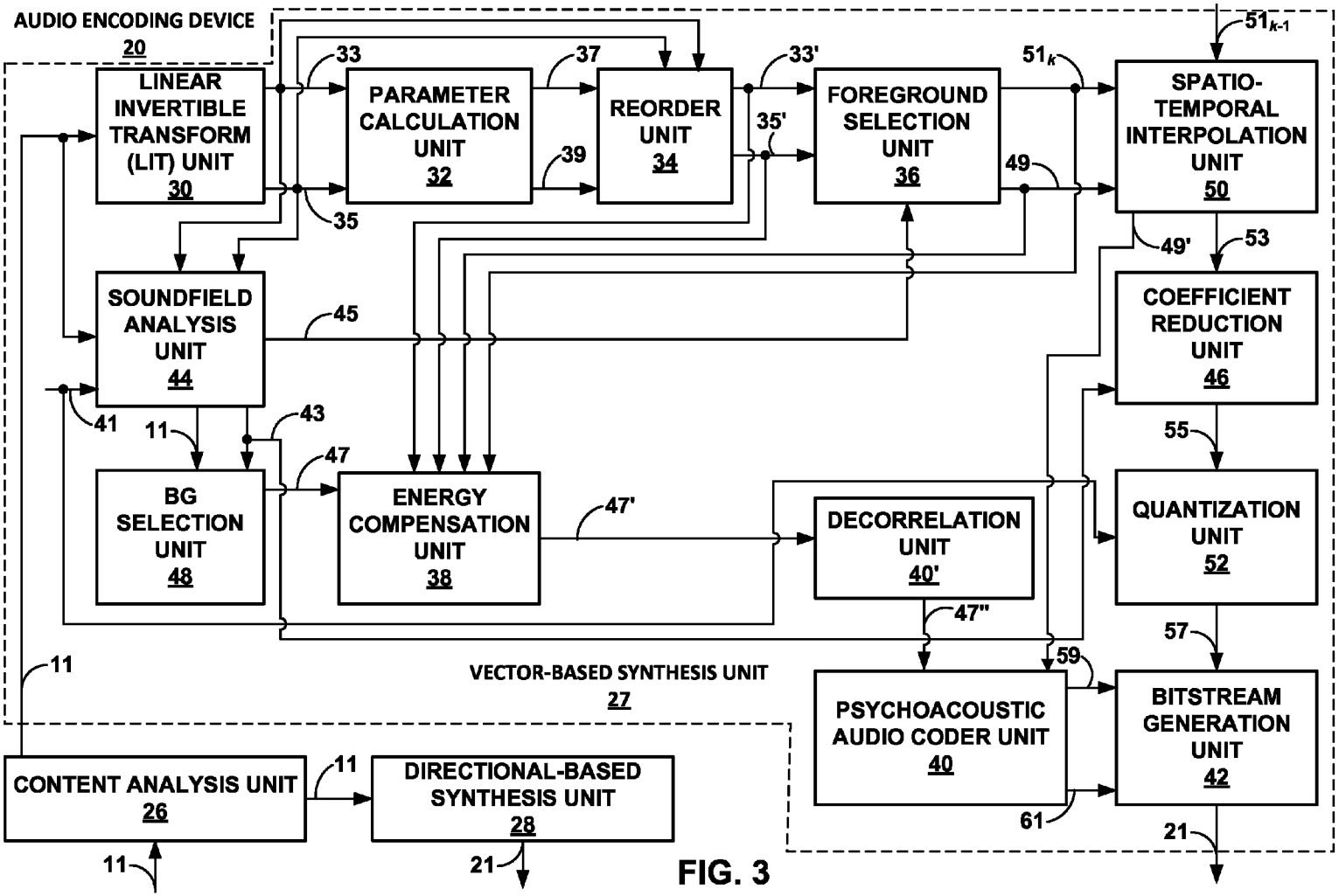
FIG. 3 is a block diagram illustrating, in more detail, one example of the audio encoding device shown in the example of FIG. 2 that may perform various aspects of the techniques described in this disclosure.

FIG. 3 is a block diagram illustrating, in more detail, one example of the audio encoding device 20 shown in the example of FIG. 2 that may perform various aspects of the techniques described in this disclosure. The audio encoding device 20 includes a content analysis unit 26, a vector-based synthesis methodology unit 27, a directional-based synthesis methodology unit 28, and a decorrelation unit 40'. Although described briefly below, more information regarding the audio encoding device 20 and the various aspects of compressing or otherwise encoding HOA coefficients is available in International Patent Application Publication No. WO 2014/194099, entitled "INTERPOLATION FOR DECOMPOSED REPRESENTATIONS OF A SOUND FIELD," filed 29 May 2014.

The content analysis unit 26 represents a unit configured to analyze the content of the HOA coefficients 11 to identify whether the HOA coefficients 11 represent content generated from a live recording or an audio object. The content analysis unit 26 may determine whether the HOA coefficients 11 were generated from a recording of an actual soundfield or from an artificial audio object. In some instances, when the framed HOA coefficients 11 were generated from a recording, the content analysis unit 26 passes the HOA coefficients 11 to the vector-based decomposition unit 27. In some instances, when the framed HOA coefficients 11 were generated from a synthetic audio object, the content analysis unit 26 passes the HOA coefficients 11 to the directional-based synthesis unit 28. The directional-based synthesis unit 28 may represent a unit configured to perform a directional-based synthesis of the HOA coefficients 11 to generate a directional-based bitstream 21.

As shown in the example of FIG. 3, the vector-based decomposition unit 27 may include a linear invertible transform (LIT) unit 30, a parameter calculation unit 32, a reorder unit 34, a foreground selection unit 36, an energy compensation unit 38, a psychoacoustic audio coder unit 40, a bitstream generation unit 42, a soundfield analysis unit 44, a coefficient reduction unit 46, a background (BG) selection unit 48, a spatio-temporal interpolation unit 50, and a quantization unit 52.

The linear invertible transform (LIT) unit 30 receives the HOA coefficients 11 in the form of HOA channels, each channel representative of a block or frame of a coefficient associated with a given order, sub-order of the spherical basis functions (which may be denoted as HOA[k], where k may denote the current frame or block of samples). The matrix of HOA coefficients 11 may have dimensions D: $M\times(N+1)^2$.

The LIT unit 30 may represent a unit configured to perform a form of analysis referred to as singular value decomposition. While described with respect to SVD, the techniques described in this disclosure may be performed with respect to any similar transformation or decomposition that provides for sets of linearly uncorrelated, energy compacted output. Also, reference to "sets" in this disclosure is generally intended to refer to non-zero sets unless specifically stated to the contrary and is not intended to refer to the classical mathematical definition of sets that includes the so-called "empty set." An alternative transformation may comprise a principal component analysis, which is often referred to as "PCA." Depending on the context, PCA may be referred to by a number of different names, such as discrete Karhunen-Loeve transform, the Hotelling transform, proper orthogonal decomposition (POD), and eigenvalue decomposition (EVD) to name a few examples. Properties of such operations that are conducive to the underlying goal of compressing audio data are 'energy compaction' and 'decorrelation' of the multichannel audio data.

In any event, assuming the LIT unit 30 performs a singular value decomposition (which, again, may be referred to as "SVD") for purposes of example, the LIT unit 30 may transform the HOA coefficients 11 into two or more sets of transformed HOA coefficients. The "sets" of transformed HOA coefficients may include vectors of transformed HOA coefficients. In the example of FIG. 3, the LIT unit 30 may perform the SVD with respect to the HOA coefficients 11 to generate a so-called V matrix, an S matrix, and a U matrix. SVD, in linear algebra, may represent a factorization of a y-by-z real or complex matrix X (where X may represent multi-channel audio data, such as the HOA coefficients 11) in the following form:

$$X=USV^*$$

U may represent a y-by-y real or complex unitary matrix, where the y columns of U are known as the left-singular vectors of the multi-channel audio data. S may represent a y-by-z rectangular diagonal matrix with non-negative real numbers on the diagonal, where the diagonal values of S are known as the singular values of the multi-channel audio data. V* (which may denote a conjugate transpose of V) may represent a z-by-z real or complex unitary matrix, where the z columns of V* are known as the right-singular vectors of the multi-channel audio data.

In some examples, the V* matrix in the SVD mathematical expression referenced above is denoted as the conjugate transpose of the V matrix to reflect that SVD may be applied to matrices comprising complex numbers. When applied to matrices comprising only real-numbers, the complex conjugate of the V matrix (or, in other words, the V* matrix) may be considered to be the transpose of the V matrix. Below it is assumed, for ease of illustration purposes, that the HOA coefficients 11 comprise real-numbers with the result that the V matrix is output through SVD rather than the V* matrix. Moreover, while denoted as the V matrix in this disclosure, reference to the V matrix should be understood to refer to the transpose of the V matrix where appropriate. While assumed to be the V matrix, the techniques may be applied in a similar fashion to HOA coefficients 11 having complex coefficients, where the output of the SVD is the V* matrix. Accordingly, the techniques should not be limited in this respect to only provide for application of SVD to generate a V matrix, but may include application of SVD to HOA coefficients 11 having complex components to generate a V* matrix.

In this way, the LIT unit 30 may perform SVD with respect to the HOA coefficients 11 to output US[k] vectors 33 (which may represent a combined version of the S vectors and the U vectors) having dimensions D: $M\times(N+1)^2$, and V[k] vectors 35 having dimensions D: $(N+1)^2\times(N+1)^2$. Individual vector elements in the US[k] matrix may also be termed $X_{PS}(k)$ while individual vectors of the V[k] matrix may also be termed v(k).

An analysis of the U, S and V matrices may reveal that the matrices carry or represent spatial and temporal characteristics of the underlying soundfield represented above by X. Each of the N vectors in U (of length M samples) may represent normalized separated audio signals as a function of time (for the time period represented by M samples), that are orthogonal to each other and that have been decoupled from any spatial characteristics (which may also be referred to as directional information). The spatial characteristics, representing spatial shape and position (r, theta, phi) may instead be represented by individual $i^{th}$ vectors, $v^{(i)}(k)$, in the V matrix (each of length $(N+1)^2$). The individual elements of each of $v^{(i)}(k)$ vectors may represent an HOA coefficient describing the shape (including width) and position of the soundfield for an associated audio object. Both the vectors in the U matrix and the V matrix are normalized such that their root-mean-square energies are equal to unity. The energy of the audio signals in U are thus represented by the diagonal elements in S. Multiplying U and S to form US [k] (with individual vector elements $X_{PS}(k)$), thus represent the audio signal with energies. The ability of the SVD decomposition to decouple the audio time-signals (in U), their energies (in S) and their spatial characteristics (in V) may support various aspects of the techniques described in this disclosure. Further, the model of synthesizing the underlying HOA[k] coefficients, X, by a vector multiplication of US[k] and V[k] gives rise the term "vector-based decomposition," which is used throughout this document.

Although described as being performed directly with respect to the HOA coefficients 11, the LIT unit 30 may apply the linear invertible transform to derivatives of the HOA coefficients 11. For example, the LIT unit 30 may apply SVD with respect to a power spectral density matrix derived from the HOA coefficients 11. By performing SVD with respect to the power spectral density (PSD) of the HOA coefficients rather than the coefficients themselves, the LIT unit 30 may potentially reduce the computational complexity of performing the SVD in terms of one or more of processor cycles and storage space, while achieving the same source audio encoding efficiency as if the SVD were applied directly to the HOA coefficients.

The parameter calculation unit 32 represents a unit configured to calculate various parameters, such as a correlation parameter (R), directional properties parameters (θ, ϕ, r), and an energy property (e). Each of the parameters for the current frame may be denoted as R[k], θ[k], ϕ[k], r[k] and e[k]. The parameter calculation unit 32 may perform an energy analysis and/or correlation (or so-called cross-correlation) with respect to the US [k] vectors 33 to identify the parameters. The parameter calculation unit 32 may also determine the parameters for the previous frame, where the previous frame parameters may be denoted R[k-1], θ[k-1], ϕ[k-1], r[k-1] and e[k-1], based on the previous frame of US[k-1] vector and V[k-1] vectors. The parameter calculation unit 32 may output the current parameters 37 and the previous parameters 39 to reorder unit 34.

The parameters calculated by the parameter calculation unit 32 may be used by the reorder unit 34 to re-order the audio objects to represent their natural evaluation or continuity over time. The reorder unit 34 may compare each of the parameters 37 from the first US [k] vectors 33 turn-wise against each of the parameters 39 for the second US[k-1] vectors 33. The reorder unit 34 may reorder (using, as one example, a Hungarian algorithm) the various vectors within the US [k] matrix 33 and the V[k] matrix 35 based on the current parameters 37 and the previous parameters 39 to output a reordered US [k] matrix 33' (which may be denoted mathematically as $\overline{US}[k]$) and a reordered V[k] matrix 35' (which may be denoted mathematically as $\overline{V}[k]$) to a foreground sound (or predominant sound—PS) selection unit 36 ("foreground selection unit 36") and an energy compensation unit 38.

The soundfield analysis unit 44 may represent a unit configured to perform a soundfield analysis with respect to the HOA coefficients 11 so as to potentially achieve a target bitrate 41. The soundfield analysis unit 44 may, based on the analysis and/or on a received target bitrate 41, determine the total number of psychoacoustic coder instantiations (which may be a function of the total number of ambient or background channels ($BG_{TOT}$) and the number of foreground channels or, in other words, predominant channels. The total number of psychoacoustic coder instantiations can be denoted as numHOATransportChannels.

The soundfield analysis unit 44 may also determine, again to potentially achieve the target bitrate 41, the total number of foreground channels (nFG) 45, the minimum order of the background (or, in other words, ambient) soundfield ($N_{BG}$ or, alternatively, MinAmbHOAorder), the corresponding number of actual channels representative of the minimum order of background soundfield (nBGa=(MinAmbHOAorder+1)$^2$), and indices (i) of additional BG HOA channels to send (which may collectively be denoted as background channel information 43 in the example of FIG. 3). The background channel information 42 may also be referred to as ambient channel information 43. Each of the channels that remains from numHOATransportChannels—nBGa, may either be an "additional background/ambient channel," an "active vector-based predominant channel," an "active directional based predominant signal" or "completely inactive." In one aspect, the channel types may be indicated (as a "ChannelType") syntax element by two bits (e.g. 00: directional based signal; 01: vector-based predominant signal; 10: additional ambient signal; 11: inactive signal). The total number of background or ambient signals, nBGa, may be given by (MinAmbHOAorder+1)$^2$+ the number of times the index 10 (in the above example) appears as a channel type in the bitstream for that frame.

The soundfield analysis unit 44 may select the number of background (or, in other words, ambient) channels and the number of foreground (or, in other words, predominant) channels based on the target bitrate 41, selecting more background and/or foreground channels when the target bitrate 41 is relatively higher (e.g., when the target bitrate 41 equals or is greater than 512 Kbps). In one aspect, the numHOATransportChannels may be set to 8 while the MinAmbHOAorder may be set to 1 in the header section of the bitstream. In this scenario, at every frame, four channels may be dedicated to represent the background or ambient portion of the soundfield while the other 4 channels can, on a frame-by-frame basis vary on the type of channel—e.g., either used as an additional background/ambient channel or a foreground/predominant channel. The foreground/predominant signals can be one of either vector-based or directional based signals, as described above.

In some instances, the total number of vector-based predominant signals for a frame, may be given by the number of times the ChannelType index is 01 in the bitstream of that frame. In the above aspect, for every additional background/ambient channel (e.g., corresponding to a ChannelType of 10), corresponding information of which of the possible HOA coefficients (beyond the first four) may be represented in that channel. The information, for fourth order HOA content, may be an index to indicate the HOA coefficients 5-25. The first four ambient HOA coefficients 1-4 may be sent all the time when minAmbHOAorder is set to 1, hence the audio encoding device may only need to indicate one of the additional ambient HOA coefficient having an index of 5-25. The information could thus be sent using a 5 bits syntax element (for $4^{th}$ order content), which may be denoted as "CodedAmbCoeffIdx." In any event, the soundfield analysis unit 44 outputs the background channel information 43 and the HOA coefficients 11 to the background (BG) selection unit 36, the background channel information 43 to coefficient reduction unit 46 and the bitstream generation unit 42, and the nFG 45 to a foreground selection unit 36.

The background selection unit 48 may represent a unit configured to determine background or ambient HOA coefficients 47 based on the background channel information (e.g., the background soundfield ($N_{BG}$) and the number (nBGa) and the indices (i) of additional BG HOA channels to send). For example, when $N_{BG}$ equals one, the background selection unit 48 may select the HOA coefficients 11 for each sample of the audio frame having an order equal to or less than one. The background selection unit 48 may, in this example, then select the HOA coefficients 11 having an index identified by one of the indices (i) as additional BG HOA coefficients, where the nBGa is provided to the bitstream generation unit 42 to be specified in the bitstream 21 so as to enable the audio decoding device, such as the audio decoding device 24 shown in the example of FIGS. 2 and 4, to parse the background HOA coefficients 47 from the bitstream 21. The background selection unit 48 may then output the ambient HOA coefficients 47 to the energy compensation unit 38. The ambient HOA coefficients 47 may have dimensions D: $M\times[(N_{BG}+1)^2+nBGa]$. The ambient HOA coefficients 47 may also be referred to as "ambient HOA coefficients 47," where each of the ambient HOA coefficients 47 corresponds to a separate ambient HOA channel 47 to be encoded by the psychoacoustic audio coder unit 40.

The foreground selection unit 36 may represent a unit configured to select the reordered US [k] matrix 33' and the reordered V[k] matrix 35' that represent foreground or distinct components of the soundfield based on nFG 45 (which may represent a one or more indices identifying the foreground vectors). The foreground selection unit 36 may output nFG signals 49 (which may be denoted as a reordered US $[k]_{1,\ldots,nFG}$ 49, $FG_{1,\ldots,nfG}[k]$ 49, or $X_{PS}^{(1\ldots nFG)}(k)$ 49) to the psychoacoustic audio coder unit 40, where the nFG signals 49 may have dimensions D: M×nFG and each represent mono-audio objects. The foreground selection unit 36 may also output the reordered V[k] matrix 35' (or $v^{(1\ldots nFG)}(k)$ 35') corresponding to foreground components of the soundfield to the spatio-temporal interpolation unit 50, where a subset of the reordered V[k] matrix 35' corresponding to the foreground components may be denoted as foreground V[k] matrix $\mathbf{51}_k$ (which may be mathematically denoted as $\overline{V}_{1,\ldots,nFG}[k]$) having dimensions D: $(N+1)^2\times$ nFG.

The energy compensation unit 38 may represent a unit configured to perform energy compensation with respect to the ambient HOA coefficients 47 to compensate for energy loss due to removal of various ones of the HOA channels by the background selection unit 48. The energy compensation unit 38 may perform an energy analysis with respect to one or more of the reordered US [k] matrix 33', the reordered V[k] matrix 35', the nFG signals 49, the foreground V[k] vectors $\mathbf{51}_k$ and the ambient HOA coefficients 47 and then perform energy compensation based on the energy analysis to generate energy compensated ambient HOA coefficients 47'. The energy compensation unit 38 may output the energy compensated ambient HOA coefficients 47' to the decorrelation unit 40'. In turn, the decorrelation unit 40' may implement techniques of this disclosure to reduce or eliminate correlation between background signals of the HOA coefficients 47' to form one or more decorrelated HOA coefficients 47". The decorrelation unit 40' may output the decorrelated HOA coefficients 47" to the psychoacoustic audio coder unit 40.

The spatio-temporal interpolation unit 50 may represent a unit configured to receive the foreground V[k] vectors $\mathbf{51}_k$ for the $k^{th}$ frame and the foreground V[k-1] vectors $\mathbf{51}_{k-1}$ for the previous frame (hence the k-1 notation) and perform spatio-temporal interpolation to generate interpolated foreground V[k] vectors. The spatio-temporal interpolation unit 50 may recombine the nFG signals 49 with the foreground V[k] vectors $\mathbf{51}_k$ to recover reordered foreground HOA coefficients. The spatio-temporal interpolation unit 50 may then divide the reordered foreground HOA coefficients by the interpolated V[k] vectors to generate interpolated nFG signals 49'. The spatio-temporal interpolation unit 50 may also output the foreground V[k] vectors $\mathbf{51}_k$ that were used to generate the interpolated foreground V[k] vectors so that an audio decoding device, such as the audio decoding device 24, may generate the interpolated foreground V[k] vectors and thereby recover the foreground V[k] vectors $\mathbf{51}_k$. The foreground V[k] vectors $\mathbf{51}_k$ used to generate the interpolated foreground V[k] vectors are denoted as the remaining foreground V[k] vectors 53. In order to ensure that the same V[k] and V[k-1] are used at the encoder and decoder (to create the interpolated vectors V[k]) quantized/dequantized versions of the vectors may be used at the encoder and decoder. The spatio-temporal interpolation unit 50 may output the interpolated nFG signals 49' to the psychoacoustic audio coder unit 46 and the interpolated foreground V[k] vectors $\mathbf{51}_k$ to the coefficient reduction unit 46.

The coefficient reduction unit 46 may represent a unit configured to perform coefficient reduction with respect to the remaining foreground V[k] vectors 53 based on the background channel information 43 to output reduced foreground V[k] vectors 55 to the quantization unit 52. The reduced foreground V[k] vectors 55 may have dimensions D: $[(N+1)^2-(N_{BG}+1)^2-BG_{TOT}]\times nFG$. The coefficient reduction unit 46 may, in this respect, represent a unit configured to reduce the number of coefficients in the remaining foreground V[k] vectors 53. In other words, coefficient reduction unit 46 may represent a unit configured to eliminate the coefficients in the foreground V[k] vectors (that form the remaining foreground V[k] vectors 53) having little to no directional information. In some examples, the coefficients of the distinct or, in other words, foreground V[k] vectors corresponding to a first and zero order basis functions (which may be denoted as $N_{BG}$) provide little directional information and therefore can be removed from the foreground V-vectors (through a process that may be referred to as "coefficient reduction"). In this example, greater flexibility may be provided to not only identify the coefficients that correspond $N_{BG}$ but to identify additional HOA channels (which may be denoted by the variable TotalOfAddAmbHOAChan) from the set of $[(N_{BG}+1)^2+1, (N+1)^2]$.

The quantization unit 52 may represent a unit configured to perform any form of quantization to compress the reduced foreground V[k] vectors 55 to generate coded foreground V[k] vectors 57, outputting the coded foreground V[k] vectors 57 to the bitstream generation unit 42. In operation, the quantization unit 52 may represent a unit configured to compress a spatial component of the soundfield, i.e., one or more of the reduced foreground V[k] vectors 55 in this example. The quantization unit 52 may perform any one of the following 12 quantization modes, as indicated by a quantization mode syntax element denoted "NbitsQ":

| NbitsQ value | Type of Quantization Mode |
|---|---|
| 0-3: | Reserved |
| 4: | Vector Quantization |
| 5: | Scalar Quantization without Huffman Coding |
| 6: | 6-bit Scalar Quantization with Huffman Coding |
| 7: | 7-bit Scalar Quantization with Huffman Coding |
| 8: | 8-bit Scalar Quantization with Huffman Coding |
| . . . | . . . |
| 16: | 16-bit Scalar Quantization with Huffman Coding |

The quantization unit 52 may also perform predicted versions of any of the foregoing types of quantization modes, where a difference is determined between an element of (or a weight when vector quantization is performed) of the V-vector of a previous frame and the element (or weight when vector quantization is performed) of the V-vector of a current frame is determined. The quantization unit 52 may then quantize the difference between the elements or weights of the current frame and previous frame rather than the value of the element of the V-vector of the current frame itself The quantization unit 52 may perform multiple forms of quantization with respect to each of the reduced foreground V[k] vectors 55 to obtain multiple coded versions of the reduced foreground V[k] vectors 55. The quantization unit 52 may select the one of the coded versions of the reduced foreground V[k] vectors 55 as the coded foreground V[k] vector 57. The quantization unit 52 may, in other words, select one of the non-predicted vector-quantized V-vector, predicted vector-quantized V-vector, the non-Huffman-coded scalar-quantized V-vector, and the Huffman-coded scalar-quantized V-vector to use as the output switched-quantized V-vector based on any combination of the criteria discussed in this disclosure. In some examples, the quantization unit 52 may select a quantization mode from a set of quantization modes that includes a vector quantization mode and one or more scalar quantization modes, and quantize an input V-vector based on (or according to) the selected mode. The quantization unit 52 may then provide the selected one of the non-predicted vector-quantized V-vector (e.g., in terms of weight values or bits indicative thereof), predicted vector-quantized V-vector (e.g., in terms of error values or bits indicative thereof), the non-Huffman-coded scalar-quantized V-vector and the Huffman-coded scalar-quantized V-vector to the bitstream generation unit 52 as the coded foreground V[k] vectors 57. The quantization unit 52 may also provide the syntax elements indicative of the quantization mode (e.g., the NbitsQ syntax element) and any other syntax elements used to dequantize or otherwise reconstruct the V-vector.

The decorrelation unit 40' included within the audio encoding device 20 may represent single or multiple instances of a unit configured to apply one or more decorrelation transforms to the HOA coefficients 47', to obtain the decorrelated HOA coefficients 47". In some examples, the decorrelation unit 40' may apply a UHJ matrix to the HOA coefficients 47'. At various instances of this disclosure, the UHJ matrix may also be referred to as a "phase-based transform." Application of the phase-based transform may also be referred to herein as "phaseshift decorrelation."

Ambisonic UHJ format is a development of the Ambisonic surround sound system designed to be compatible with mono and stereo media. The UHJ format includes a hierarchy of systems in which the recorded soundfield will be reproduced with a degree of accuracy that varies according to the available channels. In various instances, UHJ is also referred to as "C-Format". The initials indicate some of sources incorporated into the system: U from Universal (UD-4); H from Matrix H; and J from System 45J.

UHJ is a hierarchical system of encoding and decoding directional sound information within Ambisonics technology. Depending on the number of channels available, a system can carry more or less information. UHJ is fully stereo-and mono-compatible. Up to four channels (L, R, T, Q) may be used.

In one form, 2-channel (L, R) UHJ, horizontal (or "planar") surround information can be carried by normal stereo signal channels—CD, FM or digital radio, etc.—which may be recovered by using a UHJ decoder at the listening end. Summing the two channels may yield a compatible mono signal, which may be a more accurate representation of the two-channel version than summing a conventional "panpotted mono" source. If a third channel (T) is available, the third channel can be used to yield improved localization accuracy to the planar surround effect when decoded via a 3-channel UHJ decoder. The third channel may not be not required to have full audio bandwidth for this purpose, leading to the possibility of so-called "2½-channel" systems, where the third channel is bandwidth-limited. In one example, the limit may be 5 kHz. The third channel can be broadcast via FM radio, for example, by means of phase-quadrature modulation. Adding a fourth channel (Q) to the UHJ system may allow the encoding of full surround sound with height, sometimes referred to n as Periphony, with a level of accuracy identical to 4-channel B-Format.

2-channel UHJ is a format commonly used for distribution of Ambisonic recordings. 2-channel UHJ recordings can be transmitted via all normal stereo channels and any of the normal 2-channel media can be used with no alteration. UHJ is stereo compatible in that, without decoding, the listener may perceive a stereo image, but one that is significantly wider than conventional stereo (e.g., so-called "Super Stereo"). The left and right channels can also be summed for a very high degree of mono-compatibility. Replayed via a UHJ decoder, the surround capability may be revealed.

An example mathematical representation of the decorrelation unit 40' applying the UHJ matrix (or phase-based transform) is as follows:

UHJ encoding:

$$S=(0.9397*W)+(0.1856*X);$$

$$D=\text{imag}(\text{hilbert}((-0.3420*W)+(0.5099*X)))+(0.6555*Y);$$

$$T=\text{imag}(\text{hilbert}((-0.1432*W)+(0.6512*X)))-(0.7071*Y);$$

$$Q=0.9772*Z;$$

conversion of S and D to Left and Right:

Left=(S+D)/2

Right=(S−D)/2

According to some implementations of the calculations above, assumptions with respect to the calculations above may include the following: HOA Background channel are 1st order Ambisonics, FuMa normalized, in the Ambisonics channel numbering order W (a00), X(a11), Y(a11−), Z(a10).

In the calculations listed above, the decorrelation unit 40' may perform a scalar multiplication of various matrices by constant values. For instance, to obtain the S signal, the decorrelation unit 40' may perform scalar multiplication of a W matrix by the constant value of 0.9397 (e.g., by scalar multiplication), and of an X matrix by the constant value of 0.1856. As also illustrated in the calculations listed above, the decorrelation unit 40' may apply a Hilbert transform (denoted by the "Hilbert ( )" function in the above UHJ encoding) in obtaining each of the D and T signals. The "imag( )" function in the above UHJ encoding indicates that the imaginary (in the mathematical sense) of the result of the Hilbert transform is obtained.

Another example mathematical representation of the decorrelation unit 40' applying the UHJ matrix (or phase-based transform) is as follows:

UHJ Encoding:

$$S=(0.9396926*W)+(0.151520536509082*X);$$

$$D=\text{imag}(\text{hilbert}((-0.3420201*W)+(0.416299273350443*X)))+(0.535173990363608*Y);$$

$$T=0.940604061228740*(\text{imag}(\text{hilbert}((-0.1432*W)+(0.531702573500135*X)))-(0.577350269189626*Y));$$

$$Q=Z;$$

conversion of S and D to Left and Right:

Left=(S+D)/2;

Right=(S−D)/2;

In some example implementations of the calculations above, assumptions with respect to the calculations above may include the following: HOA Background channel are 1st order Ambisonics, N3D (or "full three-D") normalized, in the Ambisonics channel numbering order W (a00), X(a11), Y(a11−), Z(a10). Although described herein with respect to N3D normalization, it will be appreciated that the example calculations may also be applied to HOA background channels that are SN3D normalized (or "Schmidt semi-normalized). N3D and SN3D normalization may differ in terms of the scaling factors used. An example representation of N3D normalization, relative to SN3D normalization, is expressed below:

$$N_{l,m}^{N3D}=N_{l,m}^{SN3D}\sqrt{2l+1}$$

An example of weighting coefficients used in SN3D normalization is expressed below:

$$N_{l,m}^{SN3D}=\sqrt{\frac{2-\delta n(l-|m|)!}{4\pi\ (l+|m|)!}},\ \delta m\begin{cases}1 \text{ if } m=0\\ 0 \text{ if } m\neq 0\end{cases}$$

In the calculations listed above, the decorrelation unit 40' may perform a scalar multiplication of various matrices by constant values. For instance, to obtain the S signal, the decorrelation unit 40' may perform scalar multiplication of a W matrix by the constant value of 0. 9396926 (e.g., by scalar multiplication), and of an X matrix by the constant value of 0.151520536509082. As also illustrated in the calculations listed above, the decorrelation unit 40' may apply a Hilbert transform (denoted by the "Hilbert ( )" function in the above UHJ encoding or phaseshift decorrelation) in obtaining each of the D and T signals. The "imag( )" function in the above UHJ encoding indicates that the imaginary (in the mathematical sense) of the result of the Hilbert transform is obtained.

The decorrelation unit 40' may perform the calculations listed above, such that the resulting S and D signals represent left and right audio signals (or in other words stereo audio signals). In some such scenarios, the decorrelation unit 40' may output the T and Q signals as part of the decorrelated HOA coefficients 47", but a decoding device that receives the bitstream 21 may not process the T and Q signals when rendering to a stereo speaker geometry (or, in other words, stereo speaker configuration). In examples, the HOA coefficients 47' may represent a soundfield to be rendered on a mono-audio reproduction system. The decorrelation unit 40' may output the S and D signals as part of the decorrelated HOA coefficients 47", and a decoding device that receives the bitstream 21 may combine (or "mix") the S and D signals to form an audio signal to be rendered and/or output in mono-audio format. In these examples, the decoding device and/or the reproduction device may recover the mono-audio signal in various ways. One example is by mixing the left and right signals (represented by the S and D signals). Another example is by applying a UHJ matrix (or phase-based transform) to decode a W signal (discussed in more detail below, with respect to FIG. 5). By producing a natural left signal and a natural right signal in the form of the S and D signals by applying the UHJ matrix (or phase-based transform), the decorrelation unit 40' may implement techniques of this disclosure to provide potential advantages and/or potential improvements over techniques that apply other decorrelation transforms (such as a mode matrix described in the MPEG-H standard).

In various examples, the decorrelation unit 40' may apply different decorrelation transforms, based on a bit rate of the received HOA coefficients 47'. For example, the decorrelation unit 40' may apply the UHJ matrix (or phase-based transform) described above in scenarios where the HOA coefficients 47' represent a four-channel input. More specifically, based on the HOA coefficients 47' representing a four-channel input, the decorrelation unit 40' may apply a 4×4 UHJ matrix(or phase-based transform). For instance, the 4×4 matrix may be orthogonal to the four-channel input of the HOA coefficients 47'. In other words, in instances where the HOA coefficients 47' represent a lesser number of channels (e.g., four), the decorrelation unit 40' may apply the UHJ matrix as the selected decorrelation transform, to decorrelate the background signals of the HOA signals 47' to obtain the decorrelated HOA coefficients 47".

According to this example, if the HOA coefficients 47' represent a greater number of channels (e.g., nine), the decorrelation unit 40' may apply a decorrelation transform different from the UHJ matrix(or phase-based transform). For instance, in a scenario where the HOA coefficients 47' represent a nine-channel input, the decorrelation unit 40' may apply a mode matrix (e.g., as described in the MPEG-H standard), to decorrelate the HOA coefficients 47'. In examples where the HOA coefficients 47' represent a nine-channel input, the decorrelation unit 40' may apply a 9×9 mode matrix to obtain the decorrelated HOA coefficients 47".

In turn, various components of the audio encoding device 20 (such as the psychoacoustic audio coder 40) may perceptually code the decorrelated HOA coefficients 47" according to AAC or USAC. The decorrelation unit 40' may apply the phaseshift decorrelation transform (e.g., the UHJ matrix or phase-based transform in case of a four-channel input), to optimize the AAC/USAC coding for HOA. In examples where the HOA coefficients 47' (and thereby, the decorrelated HOA coefficients 47") represent audio data to be rendered on a stereo reproduction system, the decorrelation unit 40' may apply the techniques of this disclosure to improve or optimize compression, based on AAC and USAC being relatively oriented (or optimized for) stereo audio data.

It will be understood that the decorrelation unit 40' may apply the techniques described herein in situations where the energy compensated HOA coefficients 47' include foreground channels, as well in situations where the energy compensated HOA coefficients 47' do not include any foreground channels. As one example, the decorrelation unit 40' may apply the techniques and/or calculations described above, in a scenario where the energy compensated HOA coefficients 47' include zero (0) foreground channels and four (4) background channels (e.g., a scenario of a lower/lesser bit rate).

In some examples, the decorrelation unit 40' may cause the bitstream generation unit 42 to signal, as part of the vector-based bitstream 21, one or more syntax elements that indicate that the decorrelation unit 40' applied a decorrelation transform to the HOA coefficients 47'. By providing such an indication to a decoding device, the decorrelation unit 40' may enable the decoding device to perform reciprocal decorrelation transforms on audio data in the HOA domain. In some examples, the decorrelation unit 40' may cause the bitstream generation unit 42 to signal syntax elements that indicate which decorrelation transform was applied, such as the UHJ matrix (or other phase based transform) or the mode matrix.

The decorrelation unit 40' may apply a phase-based transform to the energy compensated ambient HOA coefficients 47'. The phase-based transform for the first $O_{MIN}$ HOA coefficient sequences of $C_{AMB}(k-1)$ is defined by $$\begin{bmatrix} x_{AMB,LOW,1}(k-2) \\ x_{AMB,LOW,2}(k-2) \\ x_{AMB,LOW,3}(k-2) \\ x_{AMB,LOW,4}(k-2) \end{bmatrix} = \begin{bmatrix} d(9)\cdot(S(k-2)+M(k-2)) \\ d(9)\cdot(M(k-2)-S(k-2)) \\ d(8)\cdot(B_{+90}(k-2)+d(5)\cdot c_{AMB,2}(k-2)) \\ c_{AMB,3}(k-2) \end{bmatrix},$$

with the coefficients d as defined in Table 1, the signal frames S(k−2) and M(k−2) being defined by $$S(k-2)=A_{+90}(k-2)+d(6)\cdot c_{AMB,2}(k-2)$$

$$M(k-2)=d(4)\cdot c_{AMB,1}(k-2)+d(5)\cdot c_{AMB,4}(k-2)$$

and $A_{+90}(k-2)$ and $B_{+90}(k-2)$ are the frames of +90 degree phase shifted signals A and B defined by $$A(k-2)=d(0)\cdot c_{AMB,LOW,1}(k-2)+d(1)\cdot c_{AMB,4}(k-2)$$

$$B(k-2)=d(2)\cdot c_{AMB,LOW,1}(k-2)+d(3)\cdot c_{AMB,4}(k-2).$$

The phase-based transform for the first $O_{MIN}$ HOA coefficient sequences of $C_{P,AMB}(k-1)$ is defined accordingly. The transform described may introduce a delay of one frame.

In the foregoing, the $x_{AMB,LOW,1}(k-2)$ through $x_{AMB,LOW,4}(k-2)$ may correspond to decorrelated ambient HOA coefficients 47". In the foregoing equation, the variable $C_{AMB,1}(k)$ variable denotes the HOA coefficients for the $k^{th}$ frame corresponding to the spherical basis functions having an (order:sub-order) of (0:0), which may also be referred to as the 'W' channel or component. The variable $C_{AMB,2}(k)$ variable denotes the HOA coefficients for the $k^{th}$ frame corresponding to the spherical basis functions having an (order:sub-order) of (1:−1), which may also be referred to as the 'Y' channel or component. The variable $C_{AMB,3}(k)$ variable denotes the HOA coefficients for the $k^{th}$ frame corresponding to the spherical basis functions having an (order:sub-order) of (1:0), which may also be referred to as the 'Z' channel or component. The variable $C_{AMB,4}(k)$ variable denotes the HOA coefficients for the $k^{th}$ frame corresponding to the spherical basis functions having an (order:sub-order) of (1:1), which may also be referred to as the 'X' channel or component. The $C_{AMB,1}(k)$ through $C_{AMB,3}(k)$ may correspond to ambient HOA coefficients 47'.

Table 1 below illustrates an example of coefficients that the decorrelation unit 40 may use for performing a phase-based transform.

TABLE 1

| Coefficients for phase-based transform | |
|---|---|
| n | d(n) |
| 0 | 0.34202009999999999 |
| 1 | 0.41629927335044281 |
| 2 | 0.14319999999999999 |
| 3 | 0.53170257350013528 |
| 4 | 0.93969259999999999 |
| 5 | 0.15152053650908184 |
| 6 | 0.53517399036360758 |
| 7 | 0.57735026918962584 |
| 8 | 0.94060406122874030 |
| 9 | 0.500000000000000 |

In some examples, various components of the audio encoding device 20 (such as the bitstream generation unit 42) may be configured to transmit only first order HOA representations for lower target bitrates (e.g., a target bitrate of 128K or 256K). According to some such examples, the audio encoding device 20 (or components thereof, such as the bitstream generation unit 42) may be configured to discard higher order HOA coefficients (e.g., coefficients with a greater order than the first order, or in other words, N>1). However, in examples where the audio encoding device 20 determines that the target bitrate is relatively high, the audio encoding device 20 (e.g., the bitstream generation unit 42) may separate the foreground and background channels, and may assign bits (e.g., in greater amounts) to the foreground channels.

The psychoacoustic audio coder unit 40 included within the audio encoding device 20 may represent multiple instances of a psychoacoustic audio coder, each of which is used to encode a different audio object or HOA channel of each of the decorrelated HOA coefficients 47" and the interpolated nFG signals 49' to generate encoded ambient HOA coefficients 59 and encoded nFG signals 61. The psychoacoustic audio coder unit 40 may output the encoded ambient HOA coefficients 59 and the encoded nFG signals 61 to the bitstream generation unit 42.

The bitstream generation unit 42 included within the audio encoding device 20 represents a unit that formats data to conform to a known format (which may refer to a format known by a decoding device), thereby generating the vector-based bitstream 21. The bitstream 21 may, in other words, represent encoded audio data, having been encoded in the manner described above. The bitstream generation unit 42 may represent a multiplexer in some examples, which may receive the coded foreground V[k] vectors 57, the encoded ambient HOA coefficients 59, the encoded nFG signals 61 and the background channel information 43. The bitstream generation unit 42 may then generate a bitstream 21 based on the coded foreground V[k] vectors 57, the encoded ambient HOA coefficients 59, the encoded nFG signals 61 and the background channel information 43. In this way, the bitstream generation unit 42 may thereby specify the vectors 57 in the bitstream 21 to obtain the bitstream 21. The bitstream 21 may include a primary or main bitstream and one or more side channel bitstreams.

Although not shown in the example of FIG. 3, the audio encoding device 20 may also include a bitstream output unit that switches the bitstream output from the audio encoding device 20 (e.g., between the directional-based bitstream 21 and the vector-based bitstream 21) based on whether a current frame is to be encoded using the directional-based synthesis or the vector-based synthesis. The bitstream output unit may perform the switch based on the syntax element output by the content analysis unit 26 indicating whether a directional-based synthesis was performed (as a result of detecting that the HOA coefficients 11 were generated from a synthetic audio object) or a vector-based synthesis was performed (as a result of detecting that the HOA coefficients were recorded). The bitstream output unit may specify the correct header syntax to indicate the switch or current encoding used for the current frame along with the respective one of the bitstreams 21.

Moreover, as noted above, the soundfield analysis unit 44 may identify $BG_{TOT}$ ambient HOA coefficients 47, which may change on a frame-by-frame basis (although at times $BG_{TOT}$ may remain constant or the same across two or more adjacent (in time) frames). The change in $BG_{TOT}$ may result in changes to the coefficients expressed in the reduced foreground V[k] vectors 55. The change in $BG_{TOT}$ may result in background HOA coefficients (which may also be referred to as "ambient HOA coefficients") that change on a frame-by-frame basis (although, again, at times $BG_{TOT}$ may remain constant or the same across two or more adjacent (in time) frames). The changes often result in a change of energy for the aspects of the sound field represented by the addition or removal of the additional ambient HOA coefficients and the corresponding removal of coefficients from or addition of coefficients to the reduced foreground V[k] vectors 55.

As a result, the soundfield analysis unit 44 may further determine when the ambient HOA coefficients change from frame to frame and generate a flag or other syntax element indicative of the change to the ambient HOA coefficient in terms of being used to represent the ambient components of the sound field (where the change may also be referred to as a "transition" of the ambient HOA coefficient or as a "transition" of the ambient HOA coefficient). In particular, the coefficient reduction unit 46 may generate the flag (which may be denoted as an AmbCoeffTransition flag or an AmbCoeffIdxTransition flag), providing the flag to the bitstream generation unit 42 so that the flag may be included in the bitstream 21 (possibly as part of side channel information).

The coefficient reduction unit 46 may, in addition to specifying the ambient coefficient transition flag, also modify how the reduced foreground V[k] vectors 55 are generated. In one example, upon determining that one of the ambient HOA ambient coefficients is in transition during the current frame, the coefficient reduction unit 46 may specify, a vector coefficient (which may also be referred to as a "vector element" or "element") for each of the V-vectors of the reduced foreground V[k] vectors 55 that corresponds to the ambient HOA coefficient in transition. Again, the ambient HOA coefficient in transition may add or remove from the $BG_{TOT}$ total number of background coefficients. Therefore, the resulting change in the total number of background coefficients affects whether the ambient HOA coefficient is included or not included in the bitstream, and whether the corresponding element of the V-vectors are included for the V-vectors specified in the bitstream in the second and third configuration modes described above. More information regarding how the coefficient reduction unit 46 may specify the reduced foreground V[k] vectors 55 to overcome the changes in energy is provided in U.S. application Ser. No. 14/594,533, entitled "TRANSITIONING OF AMBIENT HIGHER-ORDER AMBISONIC COEFFICIENTS," filed Jan. 12, 2015.

Thus, the audio encoding device 20 may represent an example of a device for compressing audio configured to apply a decorrelation transform to ambient ambisonic coefficients to obtain a decorrelated representation of the ambient ambisonic coefficients, the ambient HOA coefficients having been extracted from a plurality of higher order ambisonic coefficients and representative of a background component of a soundfield described by the plurality of higher order ambisonic coefficients, wherein at least one of the plurality of higher order ambisonic coefficients is associated with a spherical basis function having an order greater than one. In some examples, to apply the decorrelation transform, the device is configured to apply a UHJ matrix to the ambient ambisonic coefficients.

In some examples, the device is further configured to normalize the UHJ matrix according to N3D (full three-D) normalization. In some examples, the device is further configured to normalize the UHJ matrix according to according to SN3D normalization (Schmidt semi-normalization). In some examples, the ambient ambisonic coefficients are associated with spherical basis functions having an order of zero or an order of one, and to apply the UHJ matrix to the ambient ambisonic coefficients, the device is configured to perform a scalar multiplication of the UHJ matrix with respect to at least a subset of the ambient ambisonic coefficients. In some examples, to apply the decorrelation transform, the device is configured to apply a mode matrix to the ambient ambisonic coefficients.

According to some examples, to apply the decorrelation transform, the device is configured to obtain a left signal and a right signal from the decorrelated ambient ambisonic coefficients. According to some examples, the device is further configured to signal the decorrelated ambient ambisonic coefficients along with one or more foreground channels. According to some examples, to signal the decorrelated ambient ambisonic coefficients along with one or more foreground channels, the device is configured to signal the decorrelated ambient ambisonic coefficients along with one or more foreground channels in response to a determination that a target bitrate meets or exceeds a predetermined threshold.

In some examples, the device is further configured to signal the decorrelated ambient ambisonic coefficients without signaling any foreground channels. In some examples, to signal the decorrelated ambient ambisonic coefficients without signaling any foreground channels, the device is configured to signal the decorrelated ambient ambisonic coefficients without signaling any foreground channels in response to a determination that a target bitrate is below a predetermined threshold. In some examples, the device is further configured to signal an indication of the decorrelation transform having been applied to the ambient ambisonic coefficients. In some examples, the device further includes a microphone array configured to capture the audio data to be compressed.

Figure 4:
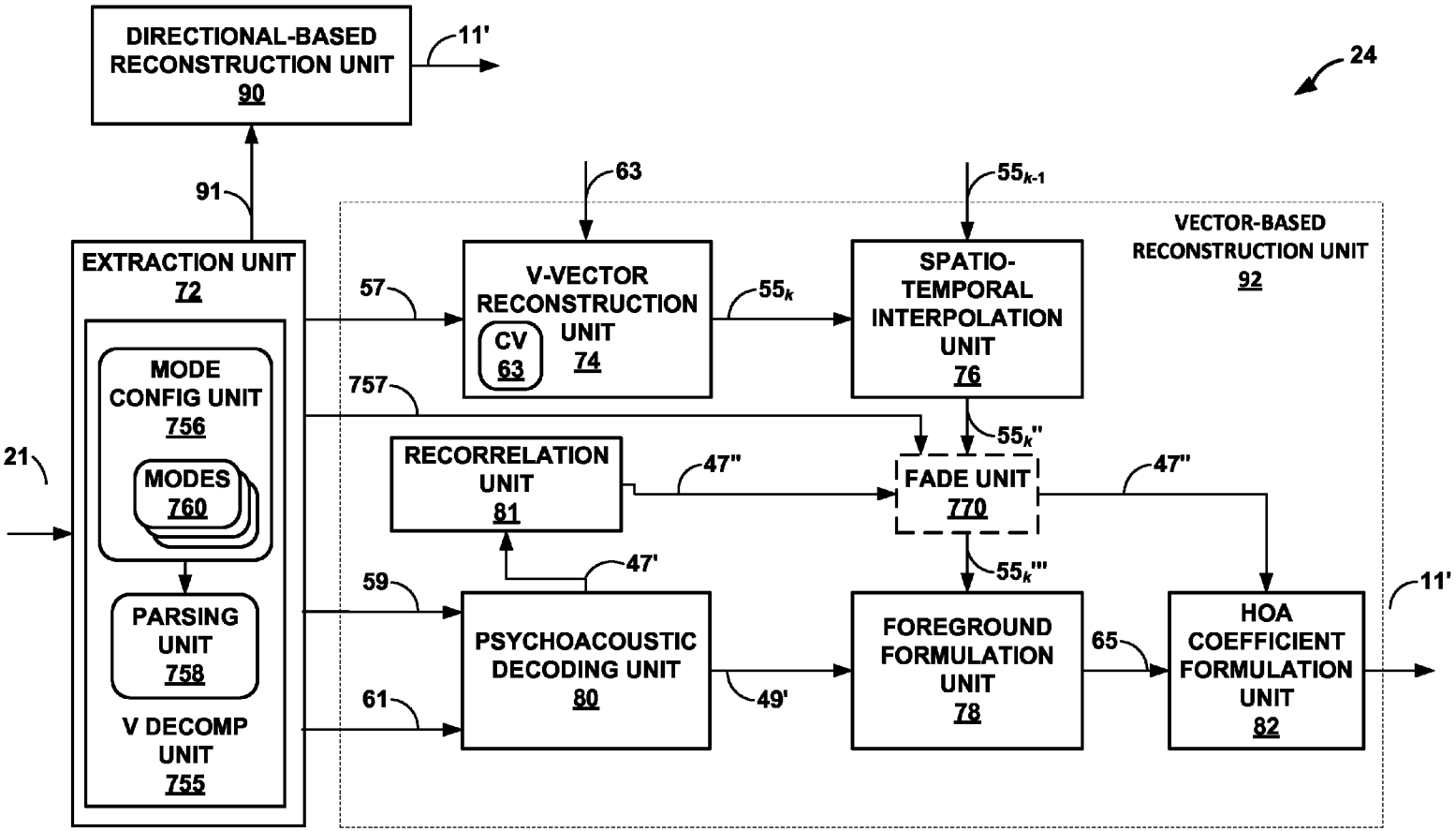
FIG. 4 is a block diagram illustrating the audio decoding device of FIG. 2 in more detail.

FIG. 4 is a block diagram illustrating the audio decoding device 24 of FIG. 2 in more detail. As shown in the example of FIG. 4 the audio decoding device 24 may include an extraction unit 72, a directionality-based reconstruction unit 90, a vector-based reconstruction unit 92, and a recorrelation unit 81.

Although described below, more information regarding the audio decoding device 24 and the various aspects of decompressing or otherwise decoding HOA coefficients is available in International Patent Application Publication No. WO 2014/194099, entitled "INTERPOLATION FOR DECOMPOSED REPRESENTATIONS OF A SOUND FIELD," filed 29 May 2014.

The extraction unit 72 may represent a unit configured to receive the bitstream 21 and extract the various encoded versions (e.g., a directional-based encoded version or a vector-based encoded version) of the HOA coefficients 11. The extraction unit 72 may determine from the above noted syntax element indicative of whether the HOA coefficients 11 were encoded via the various direction-based or vector-based versions. When a directional-based encoding was performed, the extraction unit 72 may extract the directional-based version of the HOA coefficients 11 and the syntax elements associated with the encoded version (which is denoted as directional-based information 91 in the example of FIG. 4), passing the directional based information 91 to the directional-based reconstruction unit 90. The directional-based reconstruction unit 90 may represent a unit configured to reconstruct the HOA coefficients in the form of HOA coefficients 11' based on the directional-based information 91. The bitstream and the arrangement of syntax elements within the bitstream is described below.

When the syntax element indicates that the HOA coefficients 11 were encoded using a vector-based synthesis, the extraction unit 72 may extract the coded foreground V[k] vectors 57 (which may include coded weights 57 and/or indices 63 or scalar quantized V-vectors), the encoded ambient HOA coefficients 59 and the corresponding audio objects 61 (which may also be referred to as the encoded nFG signals 61). The audio objects 61 each correspond to one of the vectors 57. The extraction unit 72 may pass the coded foreground V[k] vectors 57 to the V-vector reconstruction unit 74 and the encoded ambient HOA coefficients 59 along with the encoded nFG signals 61 to the psychoacoustic decoding unit 80.

The V-vector reconstruction unit 74 may represent a unit configured to reconstruct the V-vectors from the encoded foreground V[k] vectors 57. The V-vector reconstruction unit 74 may operate in a manner reciprocal to that of the quantization unit 52.

The psychoacoustic decoding unit 80 may operate in a manner reciprocal to the psychoacoustic audio coder unit 40 shown in the example of FIG. 3 so as to decode the encoded ambient HOA coefficients 59 and the encoded nFG signals 61 and thereby generate energy compensated ambient HOA coefficients 47' and the interpolated nFG signals 49' (which may also be referred to as interpolated nFG audio objects 49'). The psychoacoustic decoding unit 80 may pass the energy compensated ambient HOA coefficients 47' to the recorrelation unit 81 and the nFG signals 49' to the foreground formulation unit 78. In turn, the recorrelation unit 81 may apply one or more recorrelation transforms to the energy compensated ambient HOA coefficients 47" to obtain one or more recorrelated HOA coefficients 47" (or correlated HOA coefficients 47" or recorrelated ambisonic coefficients 47") and may pass the correlated HOA coefficients 47" to the HOA coefficient formulation unit 82 (optionally, through the fade unit 770).

Similarly to descriptions above, with respect to the decorrelation unit 40' of the audio encoding device 20, the recorrelation unit 81 may implement techniques of this disclosure to reduce correlation between background channels of the energy compensated ambient HOA coefficients 47' to reduce or mitigate noise unmasking. In examples where the recorrelation unit 81 applies a UHJ matrix (e.g., an inverse UHJ matrix) as the selected recorrelation transform, the recorrelation unit 81 may improve compression rates and conserve computing resources by reducing data processing operations. In some examples, the vector-based bitstream 21 may include one or more syntax elements that indicate that a decorrelation transform was applied during encoding. The inclusion of such syntax elements in the vector-based bitstream 21 may enable recorrelation unit 81 to perform reciprocal decorrelation (e.g., correlation or recorrelation) transforms on the energy compensated HOA coefficients 47'. In some examples, the signal syntax elements may indicate which decorrelation transform was applied, such as the UHJ matrix or the mode matrix, thereby enabling the recorrelation unit 81 to select the appropriate recorrelation transform to apply to the energy compensated HOA coefficients 47'.

In examples where the vector-based reconstruction unit 92 outputs the HOA coefficients 11' to a reproduction system comprising a stereo system, the recorrelation unit 81 may process the S and D signals (e.g., a natural left signal and a natural right signal) to produce the recorrelated HOA coefficients 47"(or recorrelated ambisonic coefficients 47"). For instance, because the S and D signals represent a natural left signal and natural right signal, the reproduction system may use the S and D signals as the two stereo output streams. In examples where the reconstruction unit 92 outputs the HOA coefficients 11' to a reproduction system comprising a mono-audio system, the reproduction system may combine or mix the S and D signals (as represented in the HOA coefficients 11') to obtain the mono-audio output for playback. In the example of a mono-audio system, the reproduction system may add the mixed mono-audio output to one or more foreground channels (if there are any foreground channels) to generate the audio output.

With respect to some existing UHJ-capable encoders, the signals are processed in a phase amplitude matrix to recover a set of signals that resembles B-Format. In most cases, the signal will actually be B-Format, but in the case of 2-channel UHJ, there is insufficient information available to be able to reconstruct a true B-Format signal, but rather, a signal that exhibits similar characteristics to a B-format signal. The information is then passed to an amplitude matrix that develops the speaker feeds, via a set of shelf filters, which improve the accuracy and performance of the decoder in smaller listening environments (they can be omitted in larger-scale applications). Ambisonics was designed to suit actual rooms (e.g., living rooms) and practical speaker positions: many such rooms are rectangular and as a result the basic system was designed to decode to four loudspeakers in a rectangle, with sides between 1:2 (width twice the length) and 2:1 (length twice the width) in length, thus suiting the majority of such rooms. A layout control is generally provided to allow the decoder to be configured for the loudspeaker positions. The layout control is an aspect of Ambisonic replay that differs from other surround-sound systems: the decoder may be configured specifically for the size and layout of the speaker array. The layout control may take the form of a rotary knob, a 2-way (1:2,2:1) or a 3-way (1:2,1:1,2:1) switch. Four speakers is the minimum required for horizontal surround decoding, and while a four speaker layout may be suitable for several listening environments, larger spaces may require more speakers to give full surround localization.

An example of calculations that the recorrelation unit 81 may perform with respect to applying a UHJ matrix (e.g., an inverse UHJ matrix or inverse phase-based transform) as a recorrelation transform are listed below:

UHJ decoding:
conversion of Left and Right to S and D:
S=Left+Right
D=Left−Right $$W=(0.982*S)+0.197.*\text{imag}(\text{hilbert}((0.828*D)+(0.768*T)));$$

$$X=(0.419*S)-\text{imag}(\text{hilbert}((0.828*D)+(0.768*T)));$$

$$Y=(0.796*D)-0.676*T+\text{imag}(\text{hilbert}(0.187*S));$$

$$Z=(1.023*Q);$$

In some example implementations of the calculations above, assumptions with respect to the calculations above may include the following: HOA Background channel are 1st order Ambisonics, FuMa normalized, in the Ambisonics channel numbering order W (a00), X(a11), Y(a11−), Z(a10).

An example of calculations that the recorrelation unit 81 may perform with respect to applying a UHJ matrix (or inverse phase-based transform) as a recorrelation transform are listed below:

UHJ decoding:
conversion of Left and Right to S and D:
conversion of Left and Right to S and D:
S=Left+Right;
D=Left−Right;
h1=imag(hilbert(1.014088753512236*D+T));
h2=imag(hilbert(0.229027290950227*S));

$$W=0.982*S+0.160849826442762*h1;$$

$$X=0.513168101113076*S-h1;$$

$$Y=0.974896917627705*D-0.880208333333333*T+h2;$$

$$Z=Q;$$

In some implementations of the calculations above, assumptions with respect to the calculations above may include the following: HOA Background channel are 1st order Ambisonics, N3D (or "full three-D") normalized, in the Ambisonics channel numbering order W (a00), X(a11), Y(a11−), Z(a10). Although described herein with respect to N3D normalization, it will be appreciated that the example calculations may also be applied to HOA background channels that are SN3D normalized (or "Schmidt semi-normalized). As described above with respect to FIG. 4, N3D and SN3D normalization may differ in terms of the scaling factors used. An example representation of scaling factors used in N3D normalization is described above with respect to FIG. 4. An example representation of weighting coefficients used in SN3D normalization is described above with respect to FIG. 4.

In some examples, the energy compensated HOA coefficients 47' may represent a horizontal-only layout, such as audio data that does not include any vertical channels. In these examples, the recorrelation unit 81 may not perform the calculations with respect to the Z signal above, because the Z signal represents vertical directional audio data. Instead, in these examples, the recorrelation unit 81 may only perform the calculations above with respect to the W, X, and Y signals, because the W, X, and Y signals represent horizontal directional data. In some examples where the energy compensated HOA coefficients 47' represent audio data to be rendered on a mono-audio reproduction system, the recorrelation unit 81 may only derive the W signal from the calculations above. More specifically, because the resulting W signal represents the mono-audio data, the W signal may provide all the data necessary where the energy compensated HOA coefficients 47' represents data to be rendered in mono-audio format, or where the reproduction system comprises a mono-audio system.

Similarly to as described above with respect to the decorrelation unit 40' of the audio encoding device 20, the recorrelation unit 81 may, in examples, apply the UHJ matrix (or an inverse UHJ matrix or inverse phase-based transform) in scenarios where the energy compensated HOA coefficients 47' include a lesser number of background channels, but may apply a mode matrix or inverse mode matrix (e.g., as described in the MPEG-H standard) in scenarios where the energy compensated HOA coefficients 47' include a greater number of background channels.

It will be understood that the recorrelation unit 81 may apply the techniques described herein in situations where the energy compensated HOA coefficients 47' include foreground channels, as well in situations where the energy compensated HOA coefficients 47' do not include any foreground channels. As one example, the recorrelation unit 81 may apply the techniques and/or calculations described above, in a scenario where the energy compensated HOA coefficients 47' include zero (0) foreground channels and eight (8) background channels (e.g., a scenario of a lower/lesser bit rate).

Various components of the audio decoding device 24, such as the recorrelation unit 81, may a syntax element, such as a flag UsePhaseShiftDecorr, to determine which of two processing methods was applied for decorrelation. In instances where the decorrelation unit 40' used a spatial transform for decorrelation, the recorrelation unit 81 may determine that the UsePhaseShiftDecorr flag is set to a value of zero.

In cases where the recorrelation unit 81 determines that the UsePhaseShiftDecorr flag is set to a value of one, the recorrelation unit 81 may determine that the recorrelation is to be performed using a phase-based transform. If the flag UsePhaseShiftDecorr is of value 1, the following processing is applied to reconstruct the first four coefficient sequences of the ambient HOA component by $$\begin{bmatrix} c_{AMB,1}(k) \\ c_{AMB,2}(k) \\ c_{AMB,3}(k) \\ c_{AMB,4}(k) \end{bmatrix} = \begin{bmatrix} c(3)\cdot A_{+90}(k) + c(2)\cdot[c_{I,AMB,1}(k) + c_{I,AMB,2}(k)] \\ B_{+90}(k) + c(5)\cdot[c_{I,AMB,1}(k) - c_{I,AMB,2}(k)] + c(6)\cdot c_{I,AMB,3}(k) \\ c_{I,AMB,A}(k) \\ c(4)\cdot[c_{I,AMB,}(k) + c_{I,AMB,2}(k)] - A_{+90}(k) \end{bmatrix}$$

with the coefficients c as defined in Table 1 below and $A_{+90}(k)$ and $B_{+90}(k)$ are the frames of +90 degree phase shifted signals A and B defined by $$A(k)=c(0)\cdot[c_{I,AMB,1}(k)-c_{I,AMB,2}(k)],$$

$$B(k)=c(1)\cdot[c_{I,AMB,1}(k)+c_{I,AMB,2}(k)].$$

Table 2 below illustrates example coefficients that the recorrelation unit 81 may use to implement a phase-based transform.

TABLE 2

Coefficients for phase-based transform

| n | c(n) |
|---|---|
| 0 | 1.0140887535122356 |
| 1 | 0.22902729095022714 |
| 2 | 0.98199999999999998 |
| 3 | 0.16084982644276205 |
| 4 | 0.51316810111307576 |
| 5 | 0.97489691762770481 |
| 6 | −0.88020833333333337 |

In the foregoing equation, the variable $C_{AMB,1}(k)$ variable denotes the HOA coefficients for the $k^{th}$ frame corresponding to the spherical basis functions having an (order:suborder) of (0:0), which may also be referred to as the 'W' channel or component. The variable $C_{AMB,2}(k)$ variable denotes the HOA coefficients for the $k^{th}$ frame corresponding to the spherical basis functions having an (order:suborder) of (1:−1), which may also be referred to as the 'Y' channel or component. The variable $C_{AMB,3}(k)$ variable denotes the HOA coefficients for the $k^{th}$ frame corresponding to the spherical basis functions having an (order:suborder) of (1:0), which may also be referred to as the 'Z' channel or component. The variable $C_{AMB,4}(k)$ variable denotes the HOA coefficients for the $k^{th}$ frame corresponding to the spherical basis functions having an (order:suborder) of (1:1), which may also be referred to as the 'X' channel or component. The $C_{AMB,1}(k)$ through $C_{AMB,3}(k)$ may correspond to ambient HOA coefficients 47'.

The $[C_{I,AMB,1}(k)+C_{I,AMB,2}(k)]$ notation above denotes what is alternatively referred to as 'S,' which is equivalent to the left channel plus the right channel. The $C_{I,AMB,1}(k)$ variable denotes the left channel generated as a result of UHJ encoding, while the $C_{I,AMB,2}(k)$ variable denotes the right channel generated as a result of the UHJ encoding. The 'I' notation in the subscript denotes that the corresponding channel has been decorrelated (e.g., through application of the UHJ matrix or phase-based transform) from the other ambient channels. The $[C_{I,AMB,1}(k)-C_{I,AMB,2}(k)]$ notation denotes what is referred to as 'D' throughout this disclosure, which is representative of the left channel minus the right channel. The $C_{I,AMB,3}(k)$ variable denotes what is referred to as the variable 'T' throughout this disclosure. The $C_{I,AMB,4}(k)$ variable denotes what is referred to as the variable 'Q' throughout this disclosure.

The $A_{+90}(k)$ notation denotes a positive 90 degree phase shift of c (0) multiplied by S (which is also denoted by the variable 'h1' throughout this disclosure). The $B_{+90}(k)$ notation denotes a positive 90 degree phase shift of c(1) multiplied by D (which is also denoted by the variable 'h2' throughout this disclosure).

The spatio-temporal interpolation unit 76 may operate in a manner similar to that described above with respect to the spatio-temporal interpolation unit 50. The spatio-temporal interpolation unit 76 may receive the reduced foreground V[k] vectors $\mathbf{55}_k$ and perform the spatio-temporal interpolation with respect to the foreground V[k] vectors $\mathbf{55}_k$ and the reduced foreground V[k-1] vectors $\mathbf{55}_{k-1}$ to generate interpolated foreground V[k] vectors $\mathbf{55}_k''$. The spatio-temporal interpolation unit 76 may forward the interpolated foreground V[k] vectors $\mathbf{55}_k''$ to the fade unit 770.

The extraction unit 72 may also output a signal 757 indicative of when one of the ambient HOA coefficients is in transition to fade unit 770, which may then determine which of the $SHC_{BG}$ 47' (where the $SHC_{BG}$ 47' may also be denoted as "ambient HOA channels 47'''" or "ambient HOA coefficients 47'''") and the elements of the interpolated foreground V[k] vectors $\mathbf{55}_k\mathbf{41}$ are to be either faded-in or faded-out. In some examples, the fade unit 770 may operate opposite with respect to each of the ambient HOA coefficients 47' and the elements of the interpolated foreground V[k] vectors $\mathbf{55}_k$". That is, the fade unit 770 may perform a fade-in or fade-out, or both a fade-in or fade-out with respect to corresponding one of the ambient HOA coefficients 47', while performing a fade-in or fade-out or both a fade-in and a fade-out, with respect to the corresponding one of the elements of the interpolated foreground V[k] vectors $\mathbf{55}_k$". The fade unit 770 may output adjusted ambient HOA coefficients 47" to the HOA coefficient formulation unit 82 and adjusted foreground V[k] vectors $\mathbf{55}_k$'''' to the foreground formulation unit 78. In this respect, the fade unit 770 represents a unit configured to perform a fade operation with respect to various aspects of the HOA coefficients or derivatives thereof, e.g., in the form of the ambient HOA coefficients 47' and the elements of the interpolated foreground V[k] vectors $\mathbf{55}_k$".

The foreground formulation unit 78 may represent a unit configured to perform matrix multiplication with respect to the adjusted foreground V[k] vectors $\mathbf{55}_k$'''' and the interpolated nFG signals 49' to generate the foreground HOA coefficients 65. In this respect, the foreground formulation unit 78 may combine the audio objects 49' (which is another way by which to denote the interpolated nFG signals 49') with the vectors $\mathbf{55}_k$'''' to reconstruct the foreground or, in other words, predominant aspects of the HOA coefficients 11'. The foreground formulation unit 78 may perform a matrix multiplication of the interpolated nFG signals 49' by the adjusted foreground V[k] vectors $\mathbf{55}_k$''''.

The HOA coefficient formulation unit 82 may represent a unit configured to combine the foreground HOA coefficients 65 to the adjusted ambient HOA coefficients 47" so as to obtain the HOA coefficients 11'. The prime notation reflects that the HOA coefficients 11' may be similar to but not the same as the HOA coefficients 11. The differences between the HOA coefficients 11 and 11' may result from loss due to transmission over a lossy transmission medium, quantization or other lossy operations.

UHJ is a matrix transform method that has been used to create a 2-channel stereo stream from first-order Ambisonics content. UHJ has been used in the past to transmit stereo or horizontal-only surround content via an FM transmitter. However, it will be appreciated that UHJ is not limited to use in FM transmitters. In the MPEG-H HOA encoding scheme, the HOA background channels may be pre-processed with a mode matrix to convert the HOA Background channels to orthogonal points in the spatial domain. The transformed channels are then perceptually coded via USAC or AAC.

Techniques of this disclosure are generally directed to using the UHJ transform (or phase-based transform) in the application of coding the HOA background channels instead of using this mode matrix. Both methods ((1) transforming into spatial domain via a mode matrix (2) UHJ transform) are generally directed to reducing correlation between the HOA background channels which may result in (the potentially undesired) effect of noise unmasking within the decoded soundfield.

Thus, the audio decoding device 24 may, in examples, represent a device configured to obtain a decorrelated representation of ambient ambisonic coefficients having at least a left signal and a right signal, the ambient ambisonic coefficients having been extracted from a plurality of higher order ambisonic coefficients and representative of a background component of a soundfield described by the plurality of higher order ambisonic coefficients, wherein at least one of the plurality of higher order ambisonic coefficients is associated with a spherical basis function having an order greater than one, and to generate a speaker feed based on the decorrelated representation of the ambient ambisonic coefficients. In some examples, the device is further configured to apply a recorrelation transform to the decorrelated representation of the ambient ambisonic coefficients to obtain a plurality of correlated ambient ambisonic coefficients.

In some examples, to apply the recorrelation transform, the device is configured to apply an inverse UHJ matrix (or phase-based transform) to the ambient ambisonic coefficients. According to some examples, the inverse UHJ matrix (or inverse phase-based transform) has been normalized according to N3D (full three-D) normalization. According to some examples, the inverse UHJ matrix (or inverse phase-based transform) has been normalized according to SN3D normalization (Schmidt semi-normalization).

According to some examples, the ambient ambisonic coefficients are associated with spherical basis functions having an order of zero or an order of one, and to apply the inverse UHJ matrix (or inverse phase-based transform), the device is configured to perform a scalar multiplication of the UHJ matrix with respect to the decorrelated representation of the ambient ambisonic coefficients. In some examples, to apply the recorrelation transform, the device is configured to apply an inverse mode matrix to the decorrelated representation of the ambient ambisonic coefficients. In some examples, to generate the speaker feed, the device is configured to generate, for output by a stereo reproduction system, a left speaker feed based on the left signal and a right speaker feed based on the right signal.

In some examples, to generate the speaker feed, the device is configured to use the left signal as a left speaker feed and the right signal as a right speaker feed without applying a recorrelation transform to the right and left signals. According to some examples, to generate the speaker feed, the device is configured to mix the left signal and the right signal for output by a mono audio system. According to some examples, to generate the speaker feed, the device is configured to combine the correlated ambient ambisonic coefficients with one or more foreground channels.

According to some examples, the device is further configured to determine that no foreground channels are available with which to combine the correlated ambient ambisonic coefficients. In some examples, the device is further configured to determine that the soundfield is to be output via a mono-audio reproduction system, and to decode at least a subset of the decorrelated higher order ambisonic coefficients that include data for output by the mono-audio reproduction system. In some examples, the device is further configured to obtain an indication that the decorrelated representation of ambient ambisonic coefficients was decorrelated with a decorrelation transform. According to some examples, the device further includes a loudspeaker array configured to output the speaker feed generated based on the decorrelated representation of the ambient ambisonic coefficients.

Figure 5:
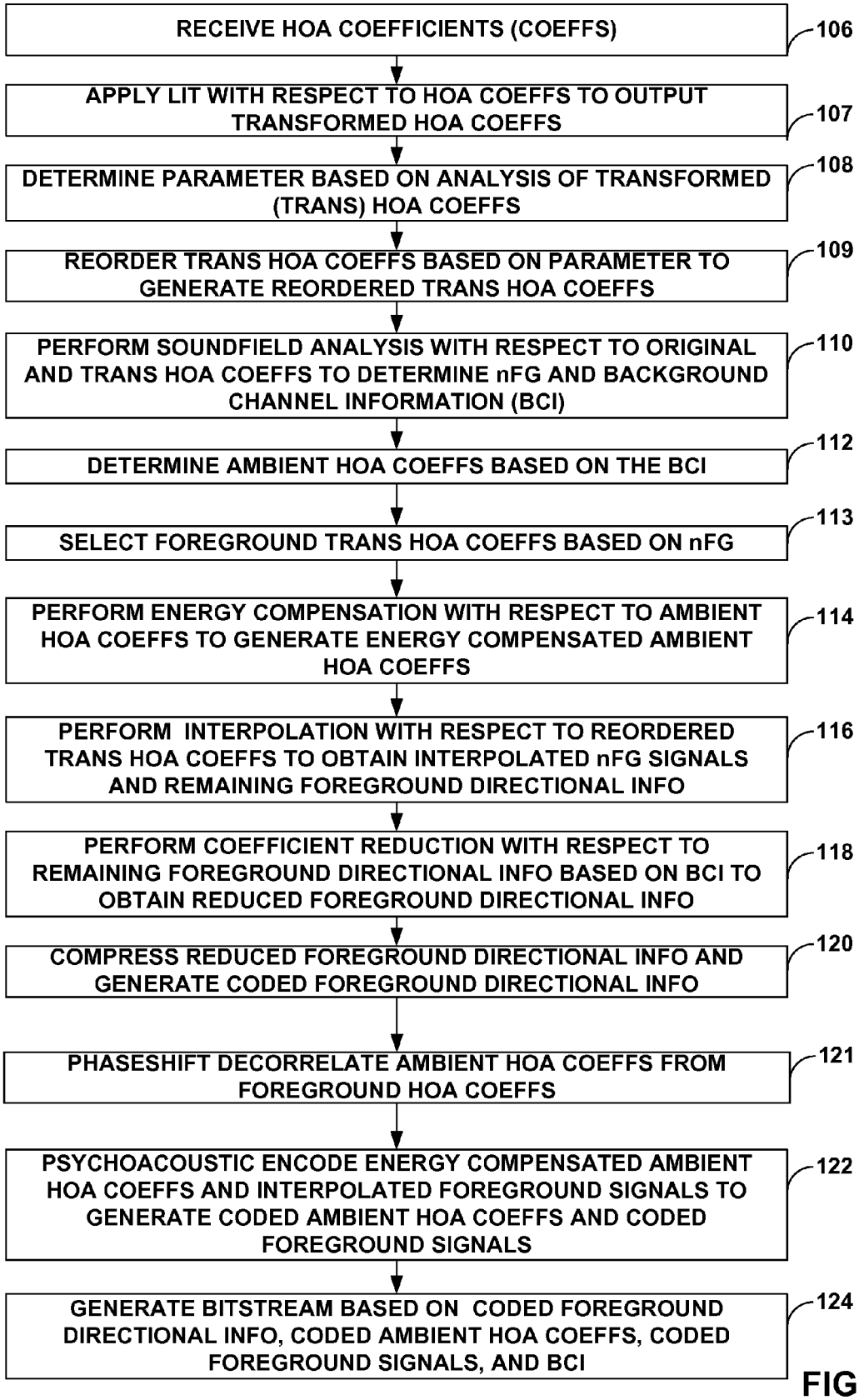
FIG. 5 is a flowchart illustrating exemplary operation of an audio encoding device in performing various aspects of the vector-based synthesis techniques described in this disclosure.

FIG. 5 is a flowchart illustrating exemplary operation of an audio encoding device, such as the audio encoding device 20 shown in the example of FIG. 3, in performing various aspects of the vector-based synthesis techniques described in this disclosure. Initially, the audio encoding device 20 receives the HOA coefficients 11 (106). The audio encoding device 20 may invoke the LIT unit 30, which may apply a LIT with respect to the HOA coefficients to output transformed HOA coefficients (e.g., in the case of SVD, the transformed HOA coefficients may comprise the US[k] vectors 33 and the V[k] vectors 35) (107).

The audio encoding device 20 may next invoke the parameter calculation unit 32 to perform the above described analysis with respect to any combination of the US [k] vectors 33, US[k-1] vectors 33, the V[k] and/or V[k-1] vectors 35 to identify various parameters in the manner described above. That is, the parameter calculation unit 32 may determine at least one parameter based on an analysis of the transformed HOA coefficients 33/35 (108).

The audio encoding device 20 may then invoke the reorder unit 34, which may reorder the transformed HOA coefficients (which, again in the context of SVD, may refer to the US[k] vectors 33 and the V[k] vectors 35) based on the parameter to generate reordered transformed HOA coefficients 33'/35' (or, in other words, the US[k] vectors 33' and the V[k] vectors 35'), as described above (109). The audio encoding device 20 may, during any of the foregoing operations or subsequent operations, also invoke the soundfield analysis unit 44. The soundfield analysis unit 44 may, as described above, perform a soundfield analysis with respect to the HOA coefficients 11 and/or the transformed HOA coefficients 33/35 to determine the total number of foreground channels (nFG) 45, the order of the background soundfield ($N_{BG}$) and the number (nBGa) and indices (i) of additional BG HOA channels to send (which may collectively be denoted as background channel information 43 in the example of FIG. 3) (109).

The audio encoding device 20 may also invoke the background selection unit 48. The background selection unit 48 may determine background or ambient HOA coefficients 47 based on the background channel information 43 (110). The audio encoding device 20 may further invoke the foreground selection unit 36, which may select the reordered US [k] vectors 33' and the reordered V [k] vectors 35' that represent foreground or distinct components of the soundfield based on nFG 45 (which may represent a one or more indices identifying the foreground vectors) (112).

The audio encoding device 20 may invoke the energy compensation unit 38. The energy compensation unit 38 may perform energy compensation with respect to the ambient HOA coefficients 47 to compensate for energy loss due to removal of various ones of the HOA coefficients by the background selection unit 48 (114) and thereby generate energy compensated ambient HOA coefficients 47'.

The audio encoding device 20 may also invoke the spatio-temporal interpolation unit 50. The spatio-temporal interpolation unit 50 may perform spatio-temporal interpolation with respect to the reordered transformed HOA coefficients 33'/35' to obtain the interpolated foreground signals 49' (which may also be referred to as the "interpolated nFG signals 49") and the remaining foreground directional information 53 (which may also be referred to as the "V[k] vectors 53") (116). The audio encoding device 20 may then invoke the coefficient reduction unit 46. The coefficient reduction unit 46 may perform coefficient reduction with respect to the remaining foreground V[k] vectors 53 based on the background channel information 43 to obtain reduced foreground directional information 55 (which may also be referred to as the reduced foreground V[k] vectors 55) (118).

The audio encoding device 20 may then invoke the quantization unit 52 to compress, in the manner described above, the reduced foreground V[k] vectors 55 and generate coded foreground V[k] vectors 57 (120). The audio encoding device 20 may also invoke the decorrelation unit 40' to apply phaseshift decorrelation to reduce or eliminate correlation between background signals of the HOA coefficients 47' to form one or more decorrelated HOA coefficients 47" (121).

The audio encoding device 20 may also invoke the psychoacoustic audio coder unit 40. The psychoacoustic audio coder unit 40 may psychoacoustic code each vector of the energy compensated ambient HOA coefficients 47' and the interpolated nFG signals 49' to generate encoded ambient HOA coefficients 59 and encoded nFG signals 61. The audio encoding device may then invoke the bitstream generation unit 42. The bitstream generation unit 42 may generate the bitstream 21 based on the coded foreground directional information 57, the coded ambient HOA coefficients 59, the coded nFG signals 61 and the background channel information 43.

Figure 6A:
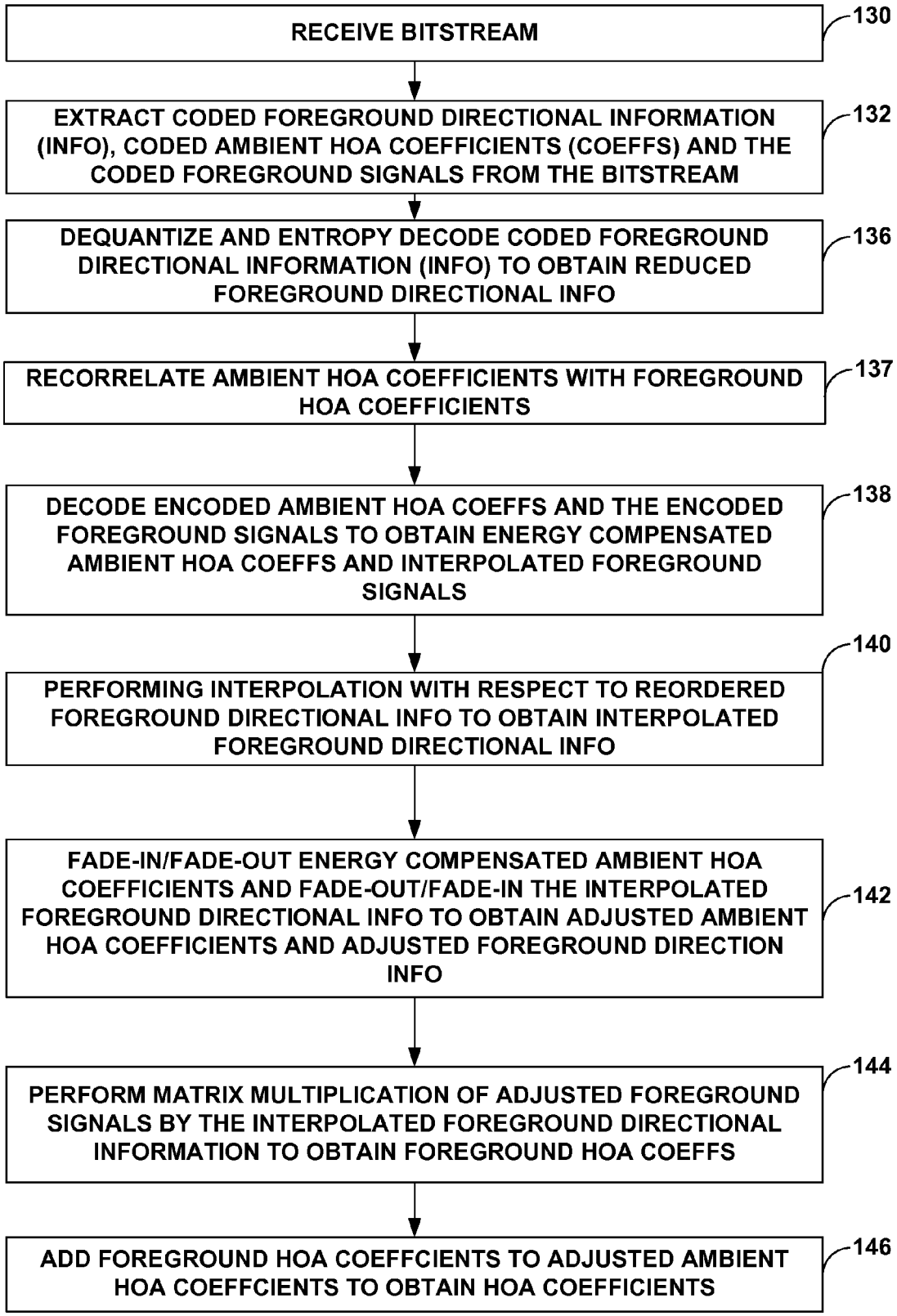
FIG. 6A is a flowchart illustrating exemplary operation of an audio decoding device in performing various aspects of the techniques described in this disclosure.

FIG. 6A is a flowchart illustrating exemplary operation of an audio decoding device, such as the audio decoding device 24 shown in FIG. 4, in performing various aspects of the techniques described in this disclosure. Initially, the audio decoding device 24 may receive the bitstream 21 (130). Upon receiving the bitstream, the audio decoding device 24 may invoke the extraction unit 72. Assuming for purposes of discussion that the bitstream 21 indicates that vector-based reconstruction is to be performed, the extraction unit 72 may parse the bitstream to retrieve the above noted information, passing the information to the vector-based reconstruction unit 92.

In other words, the extraction unit 72 may extract the coded foreground directional information 57 (which, again, may also be referred to as the coded foreground V[k] vectors 57), the coded ambient HOA coefficients 59 and the coded foreground signals (which may also be referred to as the coded foreground nFG signals 59 or the coded foreground audio objects 59) from the bitstream 21 in the manner described above (132).

The audio decoding device 24 may further invoke the dequantization unit 74. The dequantization unit 74 may entropy decode and dequantize the coded foreground directional information 57 to obtain reduced foreground directional information $55_k$ (136). The audio decoding device 24 may invoke the recorrelation unit 81. The recorrelation unit 81 may apply one or more recorrelation transforms to the energy compensated ambient HOA coefficients 47' to obtain one or more recorrelated HOA coefficients 47" (or correlated HOA coefficients 47" or recorrelated ambisonic coefficients 47") and may pass the correlated HOA coefficients 47" to the HOA coefficient formulation unit 82 (optionally, through the fade unit 770) (137). The audio decoding device 24 may also invoke the psychoacoustic decoding unit 80. The psychoacoustic audio decoding unit 80 may decode the encoded ambient HOA coefficients 59 and the encoded foreground signals 61 to obtain energy compensated ambient HOA coefficients 47' and the interpolated foreground signals 49' (138). The psychoacoustic decoding unit 80 may pass the energy compensated ambient HOA coefficients 47' to the fade unit 770 and the nFG signals 49' to the foreground formulation unit 78.

The audio decoding device 24 may next invoke the spatio-temporal interpolation unit 76. The spatio-temporal interpolation unit 76 may receive the reordered foreground directional information $55_k'$ and perform the spatio-temporal interpolation with respect to the reduced foreground directional information $55_k/55_{k-1}$ to generate the interpolated foreground directional information $55_k''$ (140). The spatio-temporal interpolation unit 76 may forward the interpolated foreground V[k] vectors $55_k''$ to the fade unit 770.

The audio decoding device 24 may invoke the fade unit 770. The fade unit 770 may receive or otherwise obtain syntax elements (e.g., from the extraction unit 72) indicative of when the energy compensated ambient HOA coefficients 47' are in transition (e.g., the AmbCoeffTransition syntax element). The fade unit 770 may, based on the transition syntax elements and the maintained transition state information, fade-in or fade-out the energy compensated ambient HOA coefficients 47' outputting adjusted ambient HOA coefficients 47'' to the HOA coefficient formulation unit 82. The fade unit 770 may also, based on the syntax elements and the maintained transition state information, and fade-out or fade-in the corresponding one or more elements of the interpolated foreground V[k] vectors $55_k''$ outputting the adjusted foreground V[k] vectors $55_k'''$ to the foreground formulation unit 78 (142).

The audio decoding device 24 may invoke the foreground formulation unit 78. The foreground formulation unit 78 may perform matrix multiplication the nFG signals 49' by the adjusted foreground directional information $55_k'''$ to obtain the foreground HOA coefficients 65 (144). The audio decoding device 24 may also invoke the HOA coefficient formulation unit 82. The HOA coefficient formulation unit 82 may add the foreground HOA coefficients 65 to adjusted ambient HOA coefficients 47'' so as to obtain the HOA coefficients 11' (146).

Figure 6B:
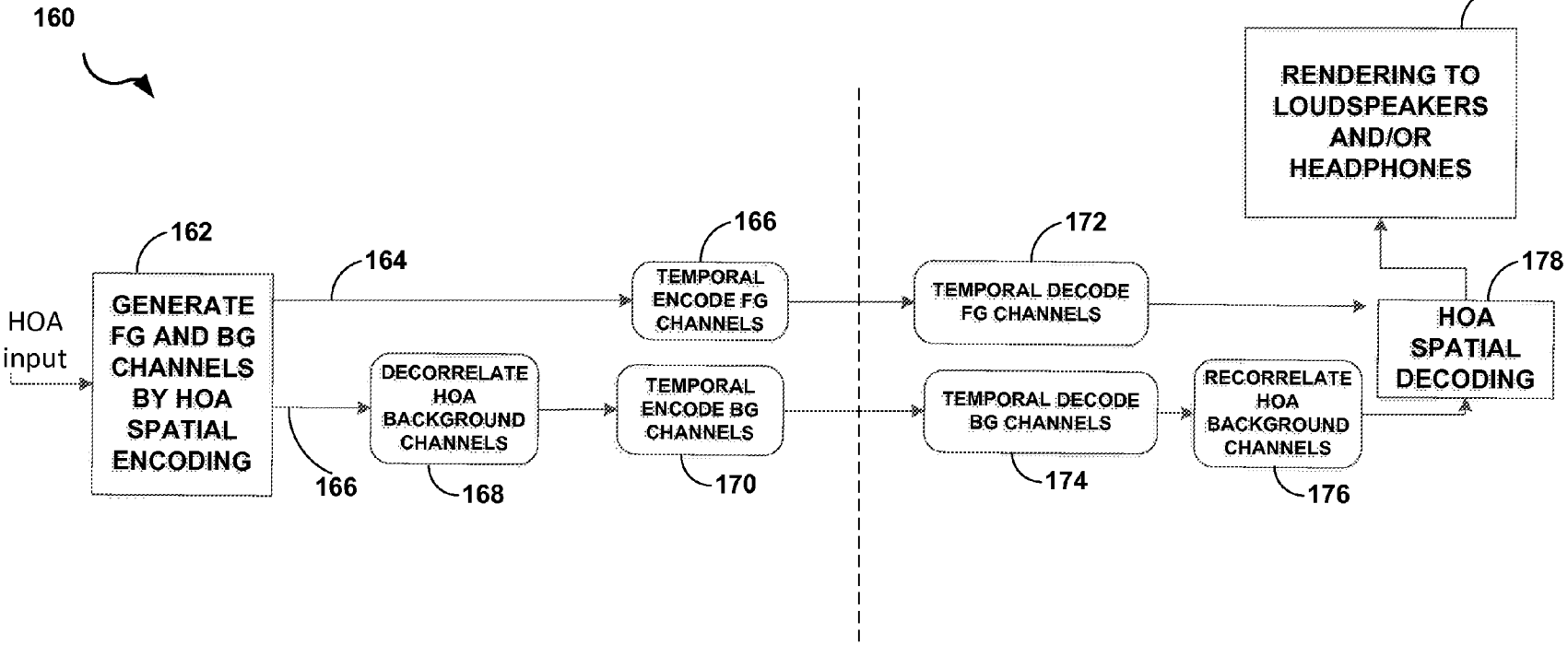
FIG. 6B is a flowchart illustrating exemplary operation of an audio encoding device and audio decoding device in performing various aspects of the coding techniques described in this disclosure.

FIG. 6B is a flowchart illustrating exemplary operation of an audio encoding device and an audio decoding device in performing the coding techniques described in this disclosure. FIG. 6B is a flowchart illustrating an example encoding and decoding process 160, in accordance with one or more aspects of this disclosure. Although process 160 may be performed by a variety of devices, for ease of discussion, process 160 is described herein with respect to the audio encoding device 20 and the audio decoding device 24 described above. The encoding and decoding sections of process 160 are demarcated using a dashed line in FIG. 6B. Process 160 may begin with one or more components of the audio encoding device 20 (e.g., the foreground selection unit 36 and the background selection unit 48) generating the foreground channels 164 and the first order HOA background channels 166 from an HOA input using HOA spatial encoding (162). In turn, the decorrelation unit 40' may apply a decorrelation transform (e.g., in the form of a phase-based decorrelation transform or matrix) to the energy compensated ambient HOA coefficients 47'. More specifically, the audio encoding device 20 may apply a UHJ matrix or phase-based decorrelation transform (e.g., by scalar multiplication) to the energy compensated ambient HOA coefficients 47' (168).

In some examples, the decorrelation unit 40' may apply the UHJ matrix (or phase-based transform) if the decorrelation unit 40', in instances where the decorrelation unit 40' determines that the HOA background channels include a lesser number of channels (e.g., four). Conversely, in these examples, if the decorrelation unit 40' determines that the HOA background channels include a greater number of channels (e.g., nine), the audio encoding device 20 may select and apply a decorrelation transform different from the UHJ matrix (such as a mode matrix described in the MPEG-H standard) to the HOA background channels. By applying the decorrelation transform (e.g., the UHJ matrix) to the HOA background channels, the audio encoding device 20 may obtain decorrelated HOA background channels.

As shown in FIG. 6B, the audio encoding device 20 (e.g., by invoking the psychoacoustic audio coder unit 40) may apply temporal encoding (e.g., by applying AAC and/or USAC) to the decorrelated HOA background signals (170) and to any foreground channels (166). It will be appreciated that, in some scenarios, the psychoacoustic audio coder unit 40 may determine that the number of foreground channels may be zero (i.e., in these scenarios, the psychoacoustic audio coder unit 40 may not obtain any foreground channels from the HOA input). As AAC and/or USAC may not be optimized or otherwise well-suited to stereo audio data, the decorrelation unit 40' may apply the decorrelation matrix to reduce or eliminate correlation between the HOA background channels. The reduced correlation shown in the decorrelated HOA background channels provide the potential advantage of mitigating or eliminating noise unmasking at the AAC/USAC temporal encoding stage, as AAC and USAC may not be optimized for stereo audio data.

In turn, the audio decoding device 24 may perform temporal decoding of the encoded bitstream output by the audio encoding device 20. In the example of process 160, one or more components of the audio decoding device 24 (e.g., the psychoacoustic decoding unit 80) may perform temporal decoding separately with respect to the foreground channels (if any foreground channels are included in the bitstream) (172) and the background channels (174). Additionally, the recorrelation unit 81 may apply a recorrelation transform to the temporally decoded HOA background channels. As an example, the recorrelation unit 81 may apply the decorrelation transform in a reciprocal manner to the decorrelation unit 40'. For instance, as described in the specific example of process 160, the recorrelation unit 81 may apply a UHJ matrix or a phase-based transform to the temporally decoded HOA background signals (176).

In some examples, the recorrelation unit 81 may apply the UHJ matrix or phase-based transform, if the recorrelation unit 81 determines that the temporally decoded HOA background channels include a lesser number of channels (e.g., four). Conversely, in these examples, if the recorrelation unit 81 determines that the temporally decoded HOA background channels include a greater number of channels (e.g., nine), the recorrelation unit 81 may select and apply a decorrelation transform different from the UHJ matrix (such as the mode matrix described in the MPEG-H standard) to the HOA background channels.

Additionally, the HOA coefficient formulation unit 82 may perform HOA spatial decoding of the correlated HOA background channels, and any available decoded foreground channels (178). In turn, the HOA coefficient formulation unit 82 may render the decoded audio signals to one or more output devices (180), such as loudspeakers and/or headphones (including, but not limited to, output devices with stereo or surround-sound capabilities).

The foregoing techniques may be performed with respect to any number of different contexts and audio ecosystems. A number of example contexts are described below, although the techniques should be limited to the example contexts. One example audio ecosystem may include audio content, movie studios, music studios, gaming audio studios, channel based audio content, coding engines, game audio stems, game audio coding/rendering engines, and delivery systems.

The movie studios, the music studios, and the gaming audio studios may receive audio content. In some examples, the audio content may represent the output of an acquisition. The movie studios may output channel based audio content (e.g., in 2.0, 5.1, and 7.1) such as by using a digital audio workstation (DAW). The music studios may output channel based audio content (e.g., in 2.0, and 5.1) such as by using a DAW. In either case, the coding engines may receive and encode the channel based audio content based one or more codecs (e.g., AAC, AC3, Dolby True HD, Dolby Digital Plus, and DTS Master Audio) for output by the delivery systems. The gaming audio studios may output one or more game audio stems, such as by using a DAW. The game audio coding/rendering engines may code and or render the audio stems into channel based audio content for output by the delivery systems. Another example context in which the techniques may be performed comprises an audio ecosystem that may include broadcast recording audio objects, professional audio systems, consumer on-device capture, HOA audio format, on-device rendering, consumer audio, TV, and accessories, and car audio systems.

The broadcast recording audio objects, the professional audio systems, and the consumer on-device capture may all code their output using HOA audio format. In this way, the audio content may be coded using the HOA audio format into a single representation that may be played back using the on-device rendering, the consumer audio, TV, and accessories, and the car audio systems. In other words, the single representation of the audio content may be played back at a generic audio playback system (i.e., as opposed to requiring a particular configuration such as 5.1, 7.1, etc.), such as audio playback system 16.

Other examples of context in which the techniques may be performed include an audio ecosystem that may include acquisition elements, and playback elements. The acquisition elements may include wired and/or wireless acquisition devices (e.g., Eigen microphones), on-device surround sound capture, and mobile devices (e.g., smartphones and tablets). In some examples, wired and/or wireless acquisition devices may be coupled to mobile device via wired and/or wireless communication channel(s).

In accordance with one or more techniques of this disclosure, the mobile device may be used to acquire a soundfield. For instance, the mobile device may acquire a soundfield via the wired and/or wireless acquisition devices and/or the on-device surround sound capture (e.g., a plurality of microphones integrated into the mobile device). The mobile device may then code the acquired soundfield into the HOA coefficients for playback by one or more of the playback elements. For instance, a user of the mobile device may record (acquire a soundfield of) a live event (e.g., a meeting, a conference, a play, a concert, etc.), and code the recording into HOA coefficients.

The mobile device may also utilize one or more of the playback elements to playback the HOA coded soundfield. For instance, the mobile device may decode the HOA coded soundfield and output a signal to one or more of the playback elements that causes the one or more of the playback elements to recreate the soundfield. As one example, the mobile device may utilize the wireless and/or wireless communication channels to output the signal to one or more speakers (e.g., speaker arrays, sound bars, etc.). As another example, the mobile device may utilize docking solutions to output the signal to one or more docking stations and/or one or more docked speakers (e.g., sound systems in smart cars and/or homes). As another example, the mobile device may utilize headphone rendering to output the signal to a set of headphones, e.g., to create realistic binaural sound.

In some examples, a particular mobile device may both acquire a 3D soundfield and playback the same 3D soundfield at a later time. In some examples, the mobile device may acquire a 3D soundfield, encode the 3D soundfield into HOA, and transmit the encoded 3D soundfield to one or more other devices (e.g., other mobile devices and/or other non-mobile devices) for playback.

Yet another context in which the techniques may be performed includes an audio ecosystem that may include audio content, game studios, coded audio content, rendering engines, and delivery systems. In some examples, the game studios may include one or more DAWs which may support editing of HOA signals. For instance, the one or more DAWs may include HOA plugins and/or tools which may be configured to operate with (e.g., work with) one or more game audio systems. In some examples, the game studios may output new stem formats that support HOA. In any case, the game studios may output coded audio content to the rendering engines which may render a soundfield for playback by the delivery systems.

The techniques may also be performed with respect to exemplary audio acquisition devices. For example, the techniques may be performed with respect to an Eigen microphone which may include a plurality of microphones that are collectively configured to record a 3D soundfield. In some examples, the plurality of microphones of Eigen microphone may be located on the surface of a substantially spherical ball with a radius of approximately 4 cm. In some examples, the audio encoding device 20 may be integrated into the Eigen microphone so as to output a bitstream 21 directly from the microphone.

Another exemplary audio acquisition context may include a production truck which may be configured to receive a signal from one or more microphones, such as one or more Eigen microphones. The production truck may also include an audio encoder, such as audio encoder 20 of FIG. 3.

The mobile device may also, in some instances, include a plurality of microphones that are collectively configured to record a 3D soundfield. In other words, the plurality of microphone may have X, Y, Z diversity. In some examples, the mobile device may include a microphone which may be rotated to provide X, Y, Z diversity with respect to one or more other microphones of the mobile device. The mobile device may also include an audio encoder, such as audio encoder 20 of FIG. 3.

A ruggedized video capture device may further be configured to record a 3D soundfield. In some examples, the ruggedized video capture device may be attached to a helmet of a user engaged in an activity. For instance, the ruggedized video capture device may be attached to a helmet of a user whitewater rafting. In this way, the ruggedized video capture device may capture a 3D soundfield that represents the action all around the user (e.g., water crashing behind the user, another rafter speaking in front of the user, etc . . . ).

The techniques may also be performed with respect to an accessory enhanced mobile device, which may be configured to record a 3D soundfield. In some examples, the mobile device may be similar to the mobile devices discussed above, with the addition of one or more accessories. For instance, an Eigen microphone may be attached to the above noted mobile device to form an accessory enhanced mobile device. In this way, the accessory enhanced mobile device may capture a higher quality version of the 3D soundfield than just using sound capture components integral to the accessory enhanced mobile device.

Example audio playback devices that may perform various aspects of the techniques described in this disclosure are further discussed below. In accordance with one or more techniques of this disclosure, speakers and/or sound bars may be arranged in any arbitrary configuration while still playing back a 3D soundfield. Moreover, in some examples, headphone playback devices may be coupled to a decoder 24 via either a wired or a wireless connection. In accordance with one or more techniques of this disclosure, a single generic representation of a soundfield may be utilized to render the soundfield on any combination of the speakers, the sound bars, and the headphone playback devices.

A number of different example audio playback environments may also be suitable for performing various aspects of the techniques described in this disclosure. For instance, a 5.1 speaker playback environment, a 2.0 (e.g., stereo) speaker playback environment, a 9.1 speaker playback environment with full height front loudspeakers, a 22.2 speaker playback environment, a 16.0 speaker playback environment, an automotive speaker playback environment, and a mobile device with ear bud playback environment may be suitable environments for performing various aspects of the techniques described in this disclosure.

In accordance with one or more techniques of this disclosure, a single generic representation of a soundfield may be utilized to render the soundfield on any of the foregoing playback environments. Additionally, the techniques of this disclosure enable a rendered to render a soundfield from a generic representation for playback on the playback environments other than that described above. For instance, if design considerations prohibit proper placement of speakers according to a 7.1 speaker playback environment (e.g., if it is not possible to place a right surround speaker), the techniques of this disclosure enable a render to compensate with the other 6 speakers such that playback may be achieved on a 6.1 speaker playback environment.

Moreover, a user may watch a sports game while wearing headphones. In accordance with one or more techniques of this disclosure, the 3D soundfield of the sports game may be acquired (e.g., one or more Eigen microphones may be placed in and/or around the baseball stadium), HOA coefficients corresponding to the 3D soundfield may be obtained and transmitted to a decoder, the decoder may reconstruct the 3D soundfield based on the HOA coefficients and output the reconstructed 3D soundfield to a renderer, the renderer may obtain an indication as to the type of playback environment (e.g., headphones), and render the reconstructed 3D soundfield into signals that cause the headphones to output a representation of the 3D soundfield of the sports game.

In each of the various instances described above, it should be understood that the audio encoding device 20 may perform a method or otherwise comprise means to perform each step of the method for which the audio encoding device 20 is configured to perform In some instances, the means may comprise one or more processors. In some instances, the one or more processors may represent a special purpose processor configured by way of instructions stored to a non-transitory computer-readable storage medium. In other words, various aspects of the techniques in each of the sets of encoding examples may provide for a non-transitory computer-readable storage medium having stored thereon instructions that, when executed, cause the one or more processors to perform the method for which the audio encoding device 20 has been configured to perform.

In one or more examples, the functions described may be implemented in hardware, software, firmware, or any combination thereof. If implemented in software, the functions may be stored on or transmitted over as one or more instructions or code on a computer-readable medium and executed by a hardware-based processing unit. Computer-readable media may include computer-readable storage media, which corresponds to a tangible medium such as data storage media. Data storage media may be any available media that can be accessed by one or more computers or one or more processors to retrieve instructions, code and/or data structures for implementation of the techniques described in this disclosure. A computer program product may include a computer-readable medium.

Likewise, in each of the various instances described above, it should be understood that the audio decoding device 24 may perform a method or otherwise comprise means to perform each step of the method for which the audio decoding device 24 is configured to perform. In some instances, the means may comprise one or more processors. In some instances, the one or more processors may represent a special purpose processor configured by way of instructions stored to a non-transitory computer-readable storage medium. In other words, various aspects of the techniques in each of the sets of encoding examples may provide for a non-transitory computer-readable storage medium having stored thereon instructions that, when executed, cause the one or more processors to perform the method for which the audio decoding device 24 has been configured to perform.

By way of example, and not limitation, such computer-readable storage media can comprise RAM, ROM, EEPROM, CD-ROM or other optical disk storage, magnetic disk storage, or other magnetic storage devices, flash memory, or any other medium that can be used to store desired program code in the form of instructions or data structures and that can be accessed by a computer. It should be understood, however, that computer-readable storage media and data storage media do not include connections, carrier waves, signals, or other transitory media, but are instead directed to non-transitory, tangible storage media. Disk and disc, as used herein, includes compact disc (CD), laser disc, optical disc, digital versatile disc (DVD), floppy disk and Blu-ray disc, where disks usually reproduce data magnetically, while discs reproduce data optically with lasers. Combinations of the above should also be included within the scope of computer-readable media.

Instructions may be executed by one or more processors, such as one or more digital signal processors (DSPs), general purpose microprocessors, application specific integrated circuits (ASICs), field programmable logic arrays (FPGAs), or other equivalent integrated or discrete logic circuitry. Accordingly, the term "processor," as used herein may refer to any of the foregoing structure or any other structure suitable for implementation of the techniques described herein. In addition, in some aspects, the functionality described herein may be provided within dedicated hardware and/or software modules configured for encoding and decoding, or incorporated in a combined codec. Also, the techniques could be fully implemented in one or more circuits or logic elements.

The techniques of this disclosure may be implemented in a wide variety of devices or apparatuses, including a wireless handset, an integrated circuit (IC) or a set of ICs (e.g., a chip set). Various components, modules, or units are described in this disclosure to emphasize functional aspects of devices configured to perform the disclosed techniques, but do not necessarily require realization by different hardware units. Rather, as described above, various units may be combined in a codec hardware unit or provided by a collection of interoperative hardware units, including one or more processors as described above, in conjunction with suitable software and/or firmware.

Various aspects of the techniques have been described. These and other aspects of the techniques are within the scope of the following claims.

What is claimed is:

1. A method of decoding ambisonic audio data, the method comprising:

obtaining, by an audio decoding device, a decorrelated representation of ambient ambisonic coefficients that are representative of a background component of a soundfield described by a plurality of higher order ambisonic cofficients, the decorrelated representation of the ambient ambisonic coefficients being decorrelated from one or more foreground components of the soundfield, wherein at least one of a plurality of higher order ambisonic coefficients describing the soundfield is associated with a spherical basis function having an order of one or zero; and applying, by the audio decoding device, a recorrelation transform to the decorrelated representation of the ambient ambisonic coefficients to obtain a plurality of recorrelated ambient ambisonic coefficients.

2. The method of claim 1, wherein applying the recorrelation transform comprises applying, by the audio decoding device, an inverse phase based transform to the ambient ambisonic coefficients.

3. The method of claim 2, wherein the inverse phase based transform has been normalized according to one of N3D (full three-D) normalization.

4. The method of claim 2, wherein the inverse phase based transform has been normalized according to SN3D normalization (Schmidt semi-normalization).

5. The method of claim 2, wherein the ambient ambisonic coefficients are associated with spherical basis functions having an order of zero or an order of one, and wherein applying the inverse phase based transform comprises performing, by the audio decoding device, a scalar multiplication of a phase based transform with respect to the decorrelated representation of the ambient ambisonic coefficients.

6. The method of claim 1, further comprising obtaining, by the audio decoding device, an indication that the decorrelated representation of ambient ambisonic coefficients was decorrelated from the one or more foreground components with a decorrelation transform.

7. The method of claim 1, further comprising:

obtaining, by the audio decoding device, one or more spatial components defining spatial characteristics of the one or more foreground components of the soundfield described by the plurality of higher order ambisonic coefficients, the spatial components defined in a spherical harmonic domain; and combining, by the audio decoding device, the recorrelated ambient ambisonic coefficients with one or more foreground channels obtained based on the one or more spatial components.

8. A device for processing ambisonic audio data, the device comprising:

a memory device configured to store at least a portion of the ambisonic audio data to be processed; and one or more processors coupled to the memory device, the one or more processors being configured to:

obtain, from the portion of the ambisonic audio data stored to the memory device, a decorrelated representation of ambient ambisonic coefficients that are representative of a background component of a soundfield described by a plurality of higher order ambisonic coefficients, the decorrelated representation of the ambient ambisonic coefficients being decorrelated from one or more foreground components of the soundfield described by the plurality of higher order ambisonic coefficients, wherein at least one of the plurality of higher order ambisonic coefficients describing the soundfield is associated with a spherical basis function having an order of one or zero, and wherein the decorrelated representation of ambient ambisonic coefficients comprises four coefficient sequences $c_{AMB,2}$, $c_{AMB,3}$, and $c_{AMB,4}$; and apply a recorrelation transform to the decorrelated representation of the ambient ambisonic coefficients to obtain a plurality of recorrelated ambient ambisonic coefficients.

9. The device of claim 8, wherein a first coefficient sequence of the four coefficient sequences is associated with a left signal, and wherein a second coefficient sequence of the four coefficient sequences is associated with a right signal.

10. The device of claim 9, wherein the one or more processors are configured to use the left signal as a left speaker feed and the right signal as a right speaker feed without application of the recorrelation transform to the right and left signals.

11. The device of claim 9, the one or more processors are configured to mix the left signal and the right signal for output by a mono audio system.

12. The device of claim 8, wherein the one or more processors are configured to combine the recorrelated ambient ambisonic coefficients with one or more foreground channels.

13. The device of claim 8, wherein the one or more processors are further configured to determine that no foreground channels are available with which to combine the recorrelated ambient ambisonic coefficients.

14. The device of claim 8, wherein the one or more processors are further configured to:

determine that the soundfield described by the plurality of higher order ambisonic coefficients is to be output via a mono-audio reproduction system; and decode at least a subset of the decorrelated ambient ambisonic coefficients that include data for output by the mono-audio reproduction system.

15. The device of claim 8, wherein the one or more processors are further configured to obtain, from the portion of the ambisonic audio data stored to the memory device, an indication that the decorrelated representation of ambient ambisonic coefficients is decorrelated from the one or more foreground components based on a decorrelation transform.

16. The device of claim 8, wherein the one or more processors are configured to generate a speaker feed based on the plurality of recorrelated ambient ambisonic coefficients, the device further comprising a loudspeaker coupled to the one or more processors, the loudspeaker being configured to output the speaker feed generated based on the recorrelated ambient ambisonic coefficients.

17. A device for compressing audio data, the device comprising:

a memory device configured to store at least a portion of the audio data to be compressed; and one or more processors coupled to the memory device, the one or more processors being configured to:

extract ambient ambisonic coefficients representative of a background component of a soundfield from a plurality of higher order ambisonic coefficients that describe the soundfield and are included in the audio data stored to the memory device, wherein at least one of the plurality of higher order ambisonic coefficients is associated with a spherical basis function having an order of one or zero;

apply a phase based transform to ambient ambisonic coefficients to decorrelate the extracted ambient ambisonic coefficients from one or more foreground components of the soundfield described by the plurality of higher order ambisonic coefficients to obtain a decorrelated representation of the ambient ambisonic coefficients; and store, to the memory device, an audio signal based on the decorrelated representation of the ambient ambisonic coefficients.

18. The device of claim 17, wherein the one or more processors are further configured to include, in the audio signal, with one or more foreground channels.

19. The device of claim 17, wherein, the one or more processors are configured to signal the decorrelated ambient ambisonic coefficients along with one or more foreground channels in response to a determination that a target bitrate associated with the audio signal meets or exceeds a predetermined threshold.

20. The device of claim 17, wherein the one or more processors are further configured to signal the decorrelated ambient ambisonic coefficients of the audio signal stored to the memory device without signaling any foreground channels of the audio signal stored to the memory device.

21. The device of claim 20, wherein the one or more processors are configured to signal the decorrelated ambient ambisonic coefficients of the audio signal stored to the memory device without signaling any foreground channels of the audio signal stored to the memory device in response to a determination that a target bitrate associated with the audio signal is below a predetermined threshold.

22. The device of claim 21, wherein the one or more processors are further configured to include, in the stored audio signal, an indication of the decorrelation transform having been applied to the ambient ambisonic coefficients.

23. The device of claim 17, further comprising a microphone coupled to the one or more processors, the microphone being configured to capture the audio data to be compressed.

24. A device for processing ambisonic audio data, the device comprising:

a memory device configured to store at least a portion of the ambisonic audio data to be processed and a UsePhaseShiftDecorr flag; and one or more processors coupled to the memory device, the one or more processors being configured to:

determine that a value of the UsePhaseShiftDecorr flag is equal to one (1);

based on the value of the UsePhaseShiftDecorr being equal to one (1), obtain, from the portion of the ambisonic audio data stored to the memory device, a decorrelated representation of ambient ambisonic coefficients that are representative of a background component of a soundfield described by a plurality of higher order ambisonic coefficients, the decorrelated representation of the ambient ambisonic coefficients being decorrelated from one or more foreground components of the soundfield described by the plurality of higher order ambisonic coefficients, wherein at least one of the plurality of higher order ambisonic coefficients describing the soundfield is associated with a spherical basis function having an order of one or zero; and apply a recorrelation transform to the decorrelated representation of the ambient ambisonic coefficients to obtain a plurality of recorrelated ambient ambisonic coefficients.

25. The device of claim 24, further comprising an interface coupled to the memory, the interface being configured to:

receive a bitstream comprising at least a portion of the ambisonic audio data; and receive the UsePhaseShiftDecorr flag.

26. The device of claim 24, wherein the one or more processors are configured to generate a speaker feed based on the plurality of recorrelated ambient ambisonic coefficients.

27. The device of claim 26, further comprising a loudspeaker coupled to the one or more processors, the loudspeaker being configured to output the speaker feed generated based on the recorrelated ambient ambisonic coefficients.

28. The device of claim 24, wherein the one or more processors are further configured to reconstruct the soundfield using the plurality of recorrelated ambient ambisonic coefficients.

29. A device for processing ambisonic audio data, the device comprising:

a memory device configured to store at least a portion of the ambisonic audio data to be processed; and one or more processors coupled to the memory device, the one or more processors being configured to:

obtain, from the portion of the ambisonic audio data stored to the memory device, a decorrelated representation of ambient ambisonic coefficients that are representative of a background component of a soundfield described by a plurality of higher order ambisonic coefficients, the decorrelated representation of the ambient ambisonic coefficients being decorrelated from one or more foreground components of the soundfield described by the plurality of higher order ambisonic coefficients, wherein at least one of the plurality of higher order ambisonic coefficients describing the soundfield is associated with a spherical basis function having an order of one or zero, and wherein the decorrelated representation of ambient ambisonic coefficients comprises four coefficient sequences $C_{I,AMB,1}$, $C_{I,AMB,2}$, $C_{I,AMB,3}$, and $C_{I,AMB,4}$; and apply a recorrelation transform to the decorrelated representation of the ambient ambisonic coefficients to obtain a plurality of recorrelated ambient ambisonic coefficients, wherein to apply the recorrelation transform, the one or more processors are configured to:

generate a first phase shifted signal based on a first multiplication product of a coefficient c(0) of the recorrelation transform and a difference between the coefficient sequences $C_{I,AMB,1}$ and $C_{I,AMB,2}$; and generate a second phase shifted signal based on a second multiplication product of a coefficient c(1) of the recorrelation transform and a sum of the coefficient sequences $C_{I,AMB,1}$ and $C_{I,AMB,2}$ .

30. The device of claim 29, wherein the one or more processors are further configured to:

generate a first combination based on a first phase shifted signal, a coefficient c(3) of the recorrelation transform, a coefficient c(2) of the recorrelation transform, and the coefficient sequences $c_{I,AMB,1}$ and $c_{I,AMB,2}$; and generate a second combination based on a second phase shifted signal, a coefficient c(5) of the recorrelation transform, a difference between the coefficient sequences $c_{I,AMB,1}$ and $c_{I,AMB,2}$, a coefficient c(6) of the recorrelation transform, and the coefficient sequence $c_{I,AMB,3}$;

obtain the coefficient sequence $c_{I,AMB,4}$; and generate a third combination based on a coefficient c(4) of the recorrelation transform, the coefficient sequences $c_{I,AMB,1}$ and $c_{I,AMB,2}$, and the first phase shifted signal.

31. The device of claim 30, wherein the recorrelation transform comprises an inverse phase based transform that is based at least in part on a set of coefficients comprising the coefficient c(0), the coefficient c(1), the coefficient c(2), the coefficient c(3), the coefficient c(4), the coefficient c(5), and the coefficient c(6), and wherein each of the coefficient c(0), the coefficient c(1), the coefficient c(2), the coefficient c(3), the coefficient c(4), the coefficient c(5), and the coefficient c(6) has a different value.

32. The device of claim 30, wherein the first combination is based on:

a third multiplication product of the coefficient c(3) and the first phase shifted signal, a fourth multiplication product of the coefficient c(2) and the sum of the coefficient sequences $c_{I,AMB,1}$ and $c_{I,AMB,2}$, and a sum of the third multiplication product and the fourth multiplication product.

33. The device of claim 30, wherein the second combination is based on:

a third multiplication product of the coefficient c(5) and the difference between the coefficient sequences $c_{I,AMB,1}$ and $c_{I,AMB,2}$, a fourth multiplication product of the coefficient c(6) and the coefficient sequence $c_{I,AMB,3}$, and a sum of the third multiplication product, the fourth multiplication product, and the second phase shifted signal.

34. The device of claim 30, wherein the third combination is based on:

a multiplication product of the coefficient c(4) and the sum of the coefficient sequences $c_{I,AMB,1}$ and $c_{I,AMB,2}$, and a sum of the multiplication product and the first phase shifted signal.

35. The device of claim 29, wherein the one or more processors are configured to generate a speaker feed based on the plurality of recorrelated ambient ambisonic coefficients.

36. The device of claim 35, further comprising a loudspeaker coupled to the one or more processors, the loudspeaker being configured to output the speaker feed generated based on the recorrelated ambient ambisonic coefficients.

37. The device of claim 29, wherein the one or more processors are further configured to reconstruct the soundfield using the plurality of recorrelated ambient ambisonic coefficient coefficients.

38. The method of claim 1, further comprising generating, by the audio decoding device, a speaker feed based on the plurality of recorrelated ambient ambisonic coefficients obtained from the application of the recorrelation transform to the decorrelated representation of the ambient ambisonic coefficients.

39. The device of claim 8, wherein the one or more processors are further configured to generate a speaker feed based on the plurality of recorrelated ambient ambisonic coefficients obtained from the application of the recorrelation transform to the decorrelated representation of the ambient ambisonic coefficients.

40. The device of claim 9, wherein the one or more processors are configured to generate, for output by a stereo reproduction system, a left speaker feed based on the left signal and a right speaker feed based on the right signal.

* * * * *